US006568788B2

(12) United States Patent
Shimizu et al.

(10) Patent No.: US 6,568,788 B2
(45) Date of Patent: May 27, 2003

(54) INK JET RECORDING APPARATUS

(75) Inventors: Yoshiaki Shimizu, Nagano (JP); Hitoshi Hayakawa, Nagano (JP); Norihiro Maruyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 09/998,428

(22) Filed: Dec. 3, 2001

(65) Prior Publication Data

US 2002/0067388 A1 Jun. 6, 2002

(30) Foreign Application Priority Data

Dec. 1, 2000 (JP) ..... 2000-366906
Mar. 21, 2001 (JP) ..... 2001-081179

(51) Int. Cl.[7] ..... B41J 2/165
(52) U.S. Cl. ..... 347/30; 347/23
(58) Field of Search ..... 347/30, 29.23, 347/32, 33, 22; 400/355, 701, 702

(56) References Cited

U.S. PATENT DOCUMENTS 6,402,289 B2 * 6/2002 Nitta ..... 347/30

* cited by examiner

*Primary Examiner*—Shih-Wen Hsieh
(74) *Attorney, Agent, or Firm*—Sughrue Mion, PLLC

(57) ABSTRACT

The driving mechanism of the cleaner includes a drive shaft having a sun gear; a gear holding lever that is rotatably and pivotally supported between two rotation stop positions on the drive shaft and rotatably holds a planet gear, which is engaged with the sun gear; and a cleaner drive lever having an inner teeth that is juxtaposed on the gear holding lever, rotatably and pivotally supported on the drive shaft, and is engageable with the planet gear; wherein the cleaner drive lever is formed of a pivotally supporting lever that is caused to turn by engagement of the planet gear with the inner teeth by rotations of the sun gear in a rotation stop state of the gear holding lever and applies a driving force to the cleaner.

11 Claims, 24 Drawing Sheets

INK JET RECORDING APPARATUS

CROSS REFERENCE TO RELATED APPLICATIONS

The present application is based on Japanese Patent Applications No. 2001-81179 and No. 2000-366906, the entire contents of which are incorporated herein by reference.

BACKGROUND OF THE INVENTION

1. Field of the Invention

The present invention relates to an ink jet recording apparatus that is provided with a wiping means (cleaner) for wiping off ink adhered to the nozzle forming surface of a recording head.

2. Description of the Related Art

With an ink jet recording apparatus, its printing noise is comparatively small, and small dots can be formed at a high density. Therefore, presently, the ink jet recording apparatus has been widely used for printing including color printing.

Such an ink jet recording apparatus is provided with an ink jet recording head that receives ink from an ink cartridge and a paper feeding means that relatively move recording paper with respect to the recording head.

Recording is carried out by discharging ink drops onto the recording paper while moving the recording head in response to printing signals and forming dots. In this case, a recording head that is capable of discharging ink of, for example, black, yellow, cyan and magenta, is mounted on the carriage, and full-color printing is enabled by varying the ratio of discharge of respective ink.

Thus, in the ink jet recording apparatus, the following problems exist since printing is carried out by discharging ink from nozzles onto recording paper as ink drops. That is, the ink viscosity is increased, resulting from evaporation of an ink solvent through the nozzle openings, ink is solidified on the nozzle forming surface, the nozzle openings are stopped up due to adhesion of dust therein, and bubbles are let in and mixed in the recording head, whereby the printing becomes inferior.

Therefore, the ink jet recording apparatus is provided with a capping means for sealing the nozzle forming surface of the recording head when printing is not executed, a suction pump for sucking ink in and discharging the same into the capping means, and a wiping means (cleaner) for cleaning the nozzle-formed plate of the recording head after ink is sucked in and discharged into the capping means by the suction pump.

In order to prevent the nozzle openings from being clogged and to prevent bubbles from entering the recording head, the nozzle forming surface of the recording head is wiped off (cleaned) by the cleaner after ink is forcibly sucked in and discharged into the capping means by the suction pump.

A process to solve such clogging of the recording head, or a forced discharge process of ink where bubbles remain in the recording head is called a "cleaning operation". The cleaning operation is carried out where printing is re-started after a long-term delay of the recording apparatus and where a user recognizes an inferiority in the printing quality such as a blurring in printing and operates the cleaning switch.

FIG. 24 shows an example of the cleaning member (a part of the cleaner) of related art. In the same drawing, the cleaning member shown by reference number 100 is composed of a rectangular piece made of a resilient material such as rubber, and is attached so as to be erect on the upper part of a sliding member (holder) 101.

In the case of wiping off the nozzle forming surface of the recording head by the cleaning member 100, the sliding member 101 advances in the horizontal direction, and in line with this action, the cleaning member 100 is caused to advance on the movement path of the recording head.

However, in the above-described ink jet recording apparatus, as shown in FIG. 25, the cleaning member 100 is resiliently deformed while being brought into contact with the nozzle forming surface of the recording head 102, in line with the movement of the recording head 102 in the direction shown by the arrow "A". Further, the tip end part of the cleaning member 100 is slidably brought into contact with the nozzle forming surface of the recording head 102 while the tip end part thereof is resiliently deformed by the movement of the recording head 102 in the direction shown by the arrow "A", wherein the surface of the nozzle forming surface is wiped off. Thereby, ink adhered to the nozzle forming surface of the recording head 102 is removed, and it is possible to prevent such a hindrance such as ink uncontrollably dropping from the recording head 102 onto recording paper, etc. during printing.

By further movement of the recording head 102 in the direction shown by the arrow "A", the recording head 102 passes the disposed position of the cleaning member 100. In this case, immediately after (or at the moment when) the recording head 102 has passed through the disposed position of the cleaning member 100, as shown in FIG. 25, the cleaning member 100 is returned in the direction shown by the arrow "C" by a resilient reset force (self-restoration force), and is reset to its initial state.

Therefore, at the moment when the cleaning member 100 resiliently returned, ink wiped off from the nozzle forming surface was splashed into the inner mechanism of the recording apparatus, particularly, the driving mechanism of the capping means positioned in the vicinity of the cleaner.

As a result, such a problem occurs, wherein ink is adhered to the driving mechanism (elevation mechanism) of the capping means, and smooth movement of the corresponding driving mechanism is hindered by solidification of the ink, resulting in a decrease of reliability with respect to the operation of the capping means.

In the related art ink jet recording apparatus, since a movement force (advancing and retreating movement) of the cleaner is provided from the drive shaft via a friction clutch (clutch plate and cleaner cam), such a problem arises, wherein smooth movement of the cleaner is not ensured with respect to the advancing and retreating movement, and reliability is lowered in the cleaner movement.

Further, if a pigment-based ink having high ink density is adhered to and is solidified on the friction surface of the friction clutch, it becomes difficult to remove ink, wherein load with respect to the friction clutch becomes uneven due to the amount of solidified ink on the friction surface, and such an inconvenience arises, wherein printing disorders may occur in the case where the drive means of the cleaner (friction clutch) is based on a paper feeding motor.

In addition thereto, since the friction clutch is constructed so as to be driven by drive of the above-described ink suction pump, the pump load is increased when driving the pump, and such an inconvenience arises, wherein durability of the pump is lowered.

SUMMARY OF THE INVENTION

The present invention was developed in view of the aforementioned problems, and it is therefore an object of the invention to provide an ink jet recording apparatus that increases the reliability of a capping means and a cleaner with respect to the movement thereof and durability of the pump where the drive shaft of the cleaner is a pump shaft of an ink suction pump, and simultaneously, can prevent printing disorder from occurring where the drive source of the cleaner is based on a paper feeding motor.

An ink jet recording apparatus according to the invention, which has been developed to achieve the aforementioned object is an ink jet recording apparatus that includes a reciprocating carriage; an ink jet recording head, which is mounted on the carriage and discharges ink drops from a nozzle forming surface, corresponding to printing data; and a cleaner, which is disposed in the vicinity of a movement path of the recording head so as to advance and retreat, and has a cleaning member to wipe off the nozzle forming surface; wherein a driving mechanism of the cleaner includes: a drive shaft, having a sun gear, which is rotatably disposed on a fixing base; a gear holding lever that is pivotally and rotatably supported between two rotation stop positions on the drive shaft and rotatably holds a planet gear engaging with the sun gear; and a cleaner drive lever, which is juxtaposed to the gear holding lever, rotatably and pivotally supported at the drive shaft, and has inner teeth engageable with the planet gear; and wherein the cleaner drive lever among these rotates by engagement of the inner teeth with the planet gear due to rotations of the sun gear in a rotation stop state of the gear holding lever, and applies a driving force to the cleaner.

Since the ink jet recording apparatus is thus constructed, the gear holding lever turns counterclockwise if the sun gear (drive shaft) is turned normally (that is, counterclockwise) when setting the cleaner. If the sun gear further rotates counterclockwise, the gear holding lever is further turned counterclockwise, and is locked at a rotation stop position at one side. If the sun gear still further turns counterclockwise in this state, the planet gear is turned clockwise in engagement with the inner teeth to cause the cleaner drive lever to turn clockwise, whereby the cleaner advances in the movement path of the recording head, and the nozzle forming surface of the recording head can be wiped off.

If the sun gear turns counterclockwise after the cleaner advances in the movement path of the recording head, the planet gear is placed at a position apart from the inner teeth, and the planet gear is disengaged from the inner teeth, wherein the cleaner drive lever does not turn.

On the other hand, if the sun gear (drive shaft) is reversed (clockwise) when resetting the cleaner, the gear holding lever turns clockwise. As the sun gear is further turned clockwise, the gear holding lever is further turned clockwise, and is locked at the other rotation stop position. In this state, if the sun gear is still further turned clockwise, the planet gear is turned counterclockwise in engagement with the inner teeth to cause the cleaner drive lever to be turned counterclockwise, whereby the cleaner is retreated from the movement path of the recording head.

If the sun gear is turned clockwise after the cleaner is retreated from the movement path of the recording head, the planet gear is placed at a position apart from the inner teeth, and the planet gear is disengaged from the inner teeth, wherein the cleaner drive lever does not turn.

Therefore, since connection and disconnection of a driving force from the drive shaft with respect to the cleaner are carried out by engagement and disengagement between the planet gear and the inner teeth, the engagement between the planet gear and the inner teeth is released immediately before the recording head passes through the advancing position of the cleaner in the movement path, thereby terminating the cleaning operation, wherein it is possible to prevent ink from being adhering to the driving mechanism of the capping means due to splashing thereof.

Therefore, since smooth movement of the driving mechanism of the capping means is not hindered, the reliability of the capping means can be improved with respect to the movement thereof.

In addition, since a driving force is transmitted from the drive shaft to the cleaner by engagement of the planet gear with the inner teeth, it is possible to securely obtain smooth movement of the cleaner, wherein the reliability with respect to the cleaner movement can be increased, and it is possible to prevent printing disorders from occurring.

Further, if the engagement of the planet gear with the inner teeth is released, it is possible to relieve the pump load where the drive shaft for causing the cleaner to advance and retreat is commonly used as the pump shaft of the ink suction pump, and the durability of the pump can be improved.

In this case, it is preferable that stoppers are provided on the above-described fixing base, corresponding to the above-described two rotation stop positions, and stopper engaging portions engageable with the respective stoppers are provided at the gear holding lever.

Since the ink jet recording apparatus is thus constructed, the stopper-engaging portion is engaged with the stopper at one side when the gear holding lever is disposed at a rotation stop position at one side. On the other hand, the stopper-engaging portion is engaged with the stopper at the other side when the gear holding lever is disposed at the rotation stop position at the other side.

It is preferable that the fixing base is composed of a frame of an ink suction pump and an attaching base thereof.

Since the ink jet recording apparatus is thus constructed, one end portion of the drive shaft is rotatably and pivotally supported on the frame, and the other end portion is rotatably and pivotally supported at the attaching base.

Further, it is preferable that the gear holding lever is composed of a lever that is resiliently deformed by rotation of the cleaner drive lever in a state where the gear holding lever is locked at the rotation stop position.

Since the ink jet recording apparatus is thus constructed, when the cleaner drive lever turns, an impact resulting from engagement of the planet gear with the inner teeth can be absorbed by the gear holding gear.

The driving mechanism is caused to include a spring, by which the cleaner drive lever is positioned so as to be urged to the cleaner set position or the cleaner reset position, in line with release of the engagement between the planet gear and the inner teeth.

Since the ink jet recording apparatus is thus constructed, as the planet gear is disengaged from the inner teeth, the cleaner drive lever is positioned at the cleaner set position or the cleaner reset position by a repulsion force of the spring.

In this case, it is preferable that the spring is composed of a torsion spring, one end of which is fixed at the attaching base, and the other end of which is fixed at the cleaner drive lever.

Since the ink jet recording apparatus is thus constructed, when positioning the lever, the cleaner drive lever receives the repulsion force of the torsion spring at an end of the spring, and is urged to the cleaner set position or the cleaner reset position.

The ink jet recording apparatus is constructed so that the fixing positions of the spring in regard to the cleaner drive lever are the same fixing positions with respect to the cleaner set position and the cleaner reset position.

Therefore, the cleaner drive lever receives the repulsion force of the torsion spring from the same fixing position, and is urged to the cleaner set position or the cleaner reset position.

In this case, such a construction maybe employed, in which the fixing positions of the spring with respect to the cleaner drive lever are positions differing from each other at the cleaner set position and the cleaner reset position.

Since the ink jet recording apparatus is thus constructed, the cleaner drive lever receives the repulsion force of the torsion spring from positions differing from each other and is urged to the cleaner set position or the cleaner reset position.

It is preferable that the drive shaft is a pump drive shaft of the ink suction pump.

Since the ink jet recording apparatus is thus constructed, the rotation force of the pump drive shaft can be used as a driving force of the cleaner.

In this case, the above driving mechanism is constructed so that the driving mechanism applies a driving force to the cleaner so that the cleaner is caused to advance to the movement path by rotations of the pump drive shaft in the suction direction and is caused to retreat from the movement path by rotations in the direction opposed to the suction direction.

Since the ink jet recording apparatus is thus constructed, when the pump drive shaft rotates in the suction direction of ink, the cleaner advances from the outside of the movement path of the recording head to the inside of the movement path. On the other hand, when the pump drive shaft rotates in the direction opposed to the suction direction of ink, the cleaner is retreated from the inside of the movement path to the outside thereof.

Further, it is preferable that the driving force is an advancing and retreating force in the direction perpendicular to the reciprocation direction of the carriage.

Since the ink jet recording apparatus is thus constructed, the cleaner advances and retreats in the direction perpendicular to the movement path of the recording head by rotations of the pump drive shaft.

DETAILED DESCRIPTION OF THE PREFERRED EMBODIMENTS

Figure 1:
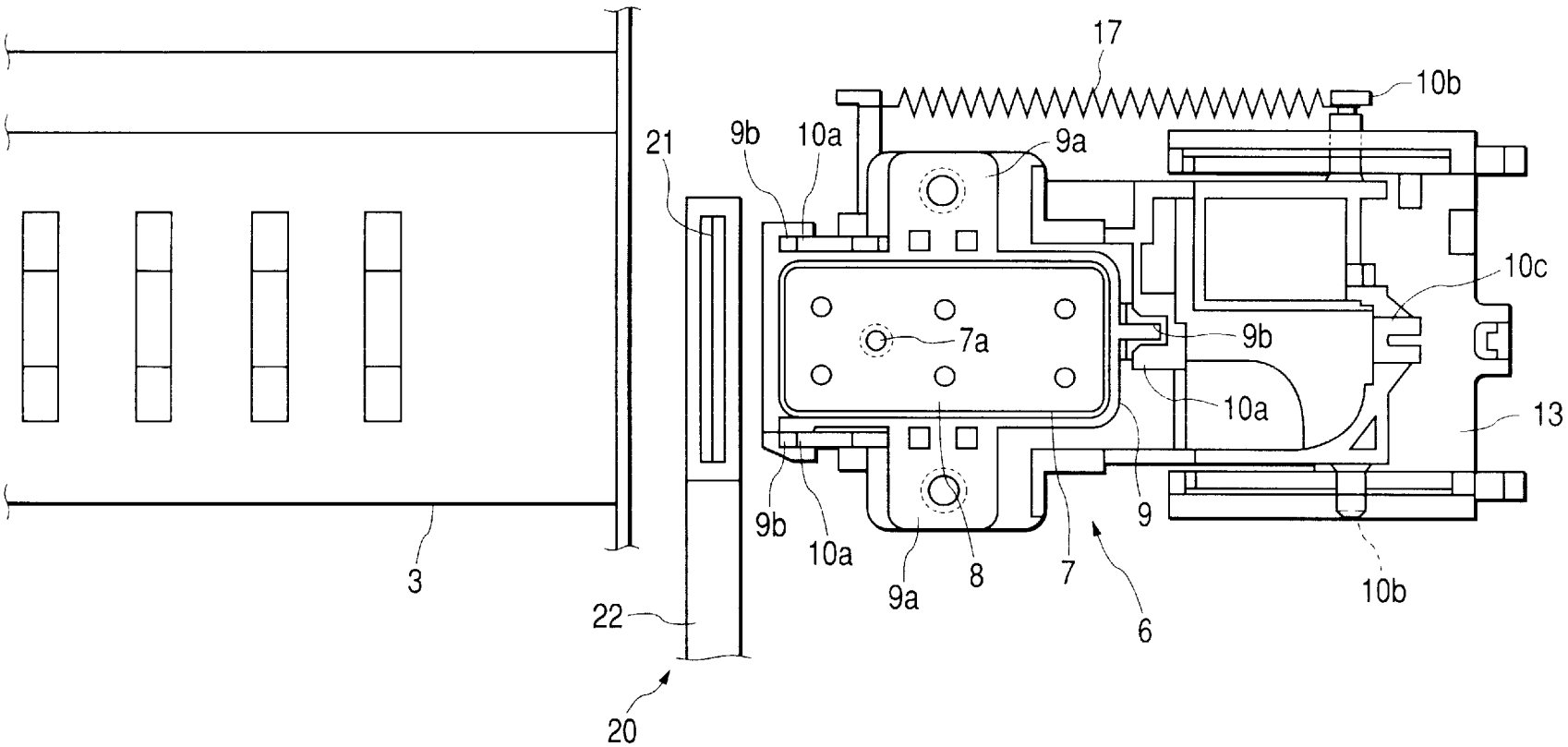
FIG. 1 is a plan view mainly showing a construction of a capping means and a wiping means in an ink jet recording apparatus to which the present invention is applied.

Hereinafter, a description is given of an ink jet recording apparatus according to the invention with reference to the embodiments shown in the drawings.

Figure 2:
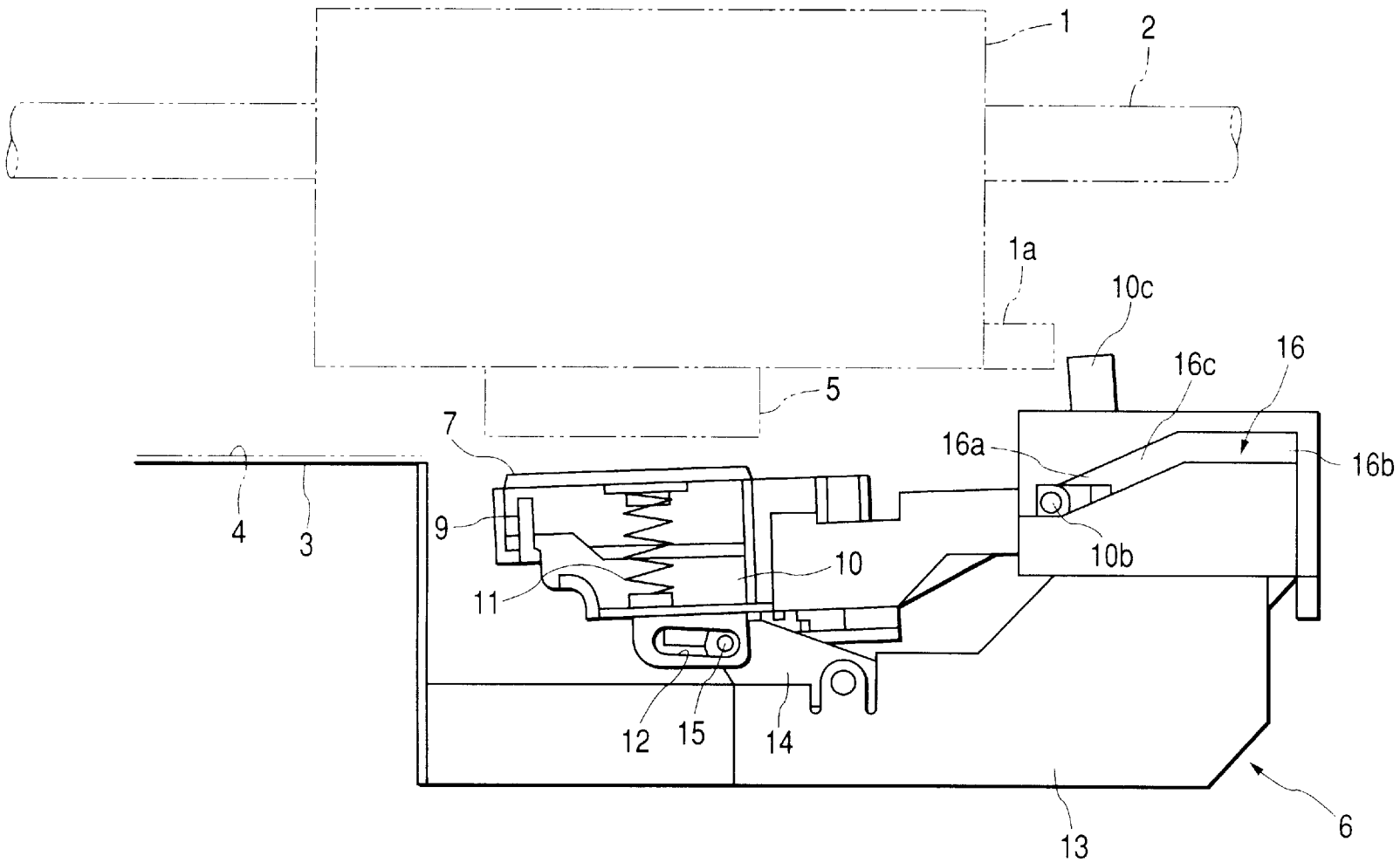
FIG. 2 is a side view showing a non-capping state in FIG. 1.
Figure 3:
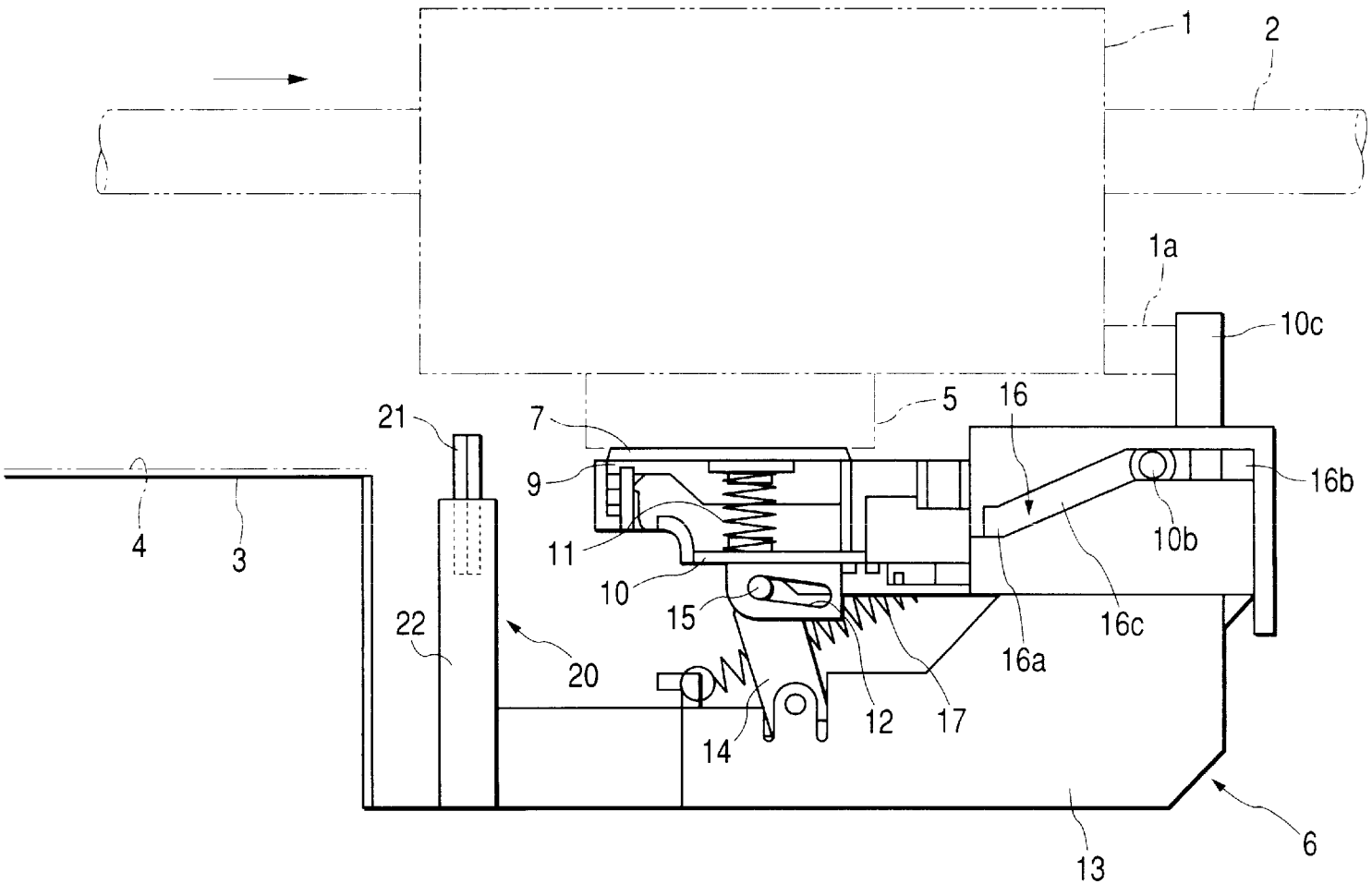
FIG. 3 is a side view showing a capping state in FIG. 1.

FIG. 1 through FIG. 3 mainly show the construction of a capping means and a wiping means in the ink jet recording apparatus to which the present invention is applied. FIG. 1 shows a state observed from above the recording apparatus, and FIG. 2 and FIG. 3 show an uncapped state and a capped state, which are observed from the side thereof.

A carriage shown by reference number 1 is coupled to a part of a timing belt (not illustrated) that reciprocates by a carriage motor (described later). The carriage 1 is guided by a guide rod 2 and is constructed so as to reciprocate in parallel with respect to a paper guide plate 3.

In the carriage 1, a recording head 5 is mounted so as to be opposed to recording paper 4 on the paper guide plate 3 when printing is carried out, whereby as ink is supplied to the recording head 5, the recording head 5 discharges ink drops onto the recording paper 4 on the paper guide plate 3, corresponding to printing data in order to execute printing.

A capping means 6 that is able to seal the nozzle forming surface of the recording head 5 is disposed at a non-printing area (home position) at the end portion of the recording apparatus. The capping means 6 has a cap member 7 made of a resilient material such as, for example, elastomer, which is formed so as to seal the nozzle forming surface with a sealing space on the nozzle forming surface of the recording head 5. The capping means 6 is provided with a feature for sealing the nozzle forming surface of the recording head 5 and preventing ink at the nozzle opening from being dried when printing is not executed, and a feature for forcedly discharging ink from the recording head 5 upon receiving negative pressure from a suction pump described later when cleaning is operated.

As shown in FIG. 1, the ink discharge port 7*a* is provided on the bottom of the cap member 7 that is disposed at the capping means 6. One end side of a tube (not illustrated), which constitutes a part of the suction pump (described later), is connected to the ink discharge port 7*a* of the cap member 7, whereby when a cleaning instruction is received, negative pressure brought about by the suction pump is applied to the inner space of the capping means 6 in a state where the nozzle forming surface of the recording head 5 is sealed, and ink can be forcedly discharged from the recording head 5.

An ink suction seat 8 is accommodated in the cap member 7, and the ink suction seat 8 is constructed so that it can absorb ink from the recording head 5 and temporarily holds the same.

The cap member 7 is integrally formed with respect to a cap holder 9 by means such as, for example, a two-color forming method. The cap holder 9 is composed of a rectangular box, and a flat plate-shaped spring receiving portion 9*a* is provided at both walls thereof so as to extend in the horizontal direction. The cap holder 9 is held on a slider 10 that constitutes a slider elevation mechanism, and is always pressed to the recording head side by a compression spring 11 resiliently mounted between the slider 10 and the spring receiving portion 9*a*.

Further, an engagement portion 9*b* is provided at a middle portion at one end of the cap holder 9 and at both sides at the other side thereof, and engagement portions 10*a*, which respectively correspond to the engagement portions 9, are provided at the slider 10, whereby the cap holder 9 is prevented from upward movement, that is, movement to the recording head side, by the respective engagement portions 9*b* being engaged with and fixed at the respective engagement members 10*a*.

A pair of long slots 12 are formed on the bottom of the slider 10 so that these long slots 12 extend in an almost horizontal direction, and a pair of horizontal axes 15, which are positioned at a free end portion of an arm 14 for slider rotation, are held in these long slots 12 so as to be movable. The non-free end portion of the arm 14 is rotatably held with respect to a frame member 13, whereby the slider 10 can be made erect with an arcuate locus via the arm 14 with respect to the frame member 13.

Guide pieces 10*b* are provided at both end sides of the slider 10 at the non-printing area side. These guide pieces 10*b* are constructed so as to be held by respective guide grooves 16 secured at the frame member 13. A low level portion 16*a* and a high level portion 16*b* are, respectively, provided at both end portions of these respective guide grooves 16, and an inclined portion 16*c* is formed between the low level portion 16*a* and the high level portion 16*b*.

One of both the guide pieces 10*b* is, as shown in FIG. 1, connected to the frame member 13 via a tension spring 17, whereby the slider 10 approaches the printing area, and is pressed downward in the direction separating from the recording head 5, that is, is entered from the state shown in FIG. 3 into the state shown in FIG. 2.

As shown in FIG. 2, when the carriage 1 moves right above the capping means 6, the engagement member 1*a* provided in the carriage 1 is engaged with the engagement portion 10*c* that is provided so as to be erect on the slider 10, and the slider 10 is erected via the arm 14 against a repulsion force of the tension spring 17 as shown in FIG. 3. Therefore, the nozzle forming surface of the recording head 5 can be sealed by the cap member 7.

In the case where the carriage 1 moves to the printing area side, abutment of the engagement member 1*a* with the engagement portion 10*c* is cancelled, and the slider 10 is entered into the state shown in FIG. 2 by the repulsion force of the tension spring 17, whereby it is possible to cancel the sealing of the nozzle forming surface in the recording head 5 by the cap member 7.

In addition, as shown in FIG. 2, the sealing surface in the cap member 7, that is, the upward end surface that is brought into contact with the nozzle forming surface of the recording head 5, is disposed so as to become non-parallel to the nozzle forming surface of the recording head 5. In other words, the sealing surface of the cap member 7 is disposed in an inclined state so that the same is positioned slightly downward of the printing area side with respect to the end portion at the home position side (the right side in FIG. 2).

The cap member 7 is first brought into contact with the nozzle forming surface from the home position side end portion where the nozzle forming surface of the recording head 5 is sealed, and operates so that the entirety of the nozzle forming surface of the recording head 5 is sealed in line with elevation of the slider 10. In addition, the cap member 7 is first separated from the printing area side end portion with respect to the nozzle forming surface of the recording head 5 where the nozzle forming surface of the recording head 5 is sealed, and the upper end surface of the cap member 7 becomes non-parallel.

On the other hand, as shown in FIG. 1 and FIG. 3, a wiping means (cleaner) 20 that wipes off the nozzle forming surface of the recording head 5 in line with movement of the carriage 1 is disposed at the printing area adjacent to the capping means 6. The wiping means 20 has a wiping member (cleaning member) 21 made of a resilient material such as, for example, rubber, and a holder 22 to hold the same wiping member 21.

The wiping means 20 moves in the horizontal direction perpendicular to the reciprocation direction of the carriage 1 as described later, wherein the wiping member 21 is constructed so that the same advances to the wiping position in the movement path of the recording head 5, and retreats from the advancing position to the outside of the movement path.

Therefore, when operating to clean, the wiping member 21 removes dust and paper chips adhered to the nozzle forming surface before sucking ink, and wipes off ink adhered to the nozzle forming surface after the suction.

In this case, for moving operations of the wiping means 20 and suction operations of the pump that makes the pressure of the inner space of the capping means 6 negative, a driving force of a paper feeding motor (described later) that transfers recording paper 4 on the paper guide 3 is utilized. The wiping member 21 is constructed so that the same advances to the movement path of the recording head 5 and retreats therefrom in line with the driving operations of the pump.

With the above-described construction, as the carriage 1 moves to the non-printing area (home position) by drive of the carriage motor, the engaging member 1*a* of the carriage 1 is engaged with the engagement portion 10*c* of the slider 10 as shown in FIG. 2. By the carriage 1 moving to the home position side, the slider 10 is elevated with the arm 14 against the repulsion force of the tension spring 17 as shown in FIG. 3. In this case, the guide piece 10*b* of the slider 10 moves from the low-level portion 16*a* of the guide groove 16 to the high level portion 16*b* thereof via the inclined portion 16*c*, whereby the nozzle forming surface of the recording head 5 is sealed by the cap member 7.

Thus, at the stage where the sealing of the nozzle forming surface is completed by the cap member 7, the cap member 7 interrupts communication with the atmospheric air to bring about an airtight state, wherein evaporation of ink through the nozzle opening can be suppressed, and the recording head 5 is prevented from clogging.

On the other hand, as the carriage 1 moves to the printing area side by drive of the carriage motor, the engaging member 1*a* of the carriage 1 is separated from the engaging portion 10*c* of the slider 10.

Therefore, the slider 10 is lowered via the arm 14 by the repulsion force of the tension spring 17. In this case, the guide piece 10*b* of the slider 10 moves from the high level portion 16*b* to the low level portion 16*a* via the inclined portion 16*c*, whereby the sealing of the recording head 5 by the cap member 7 is cancelled.

Figure 4:
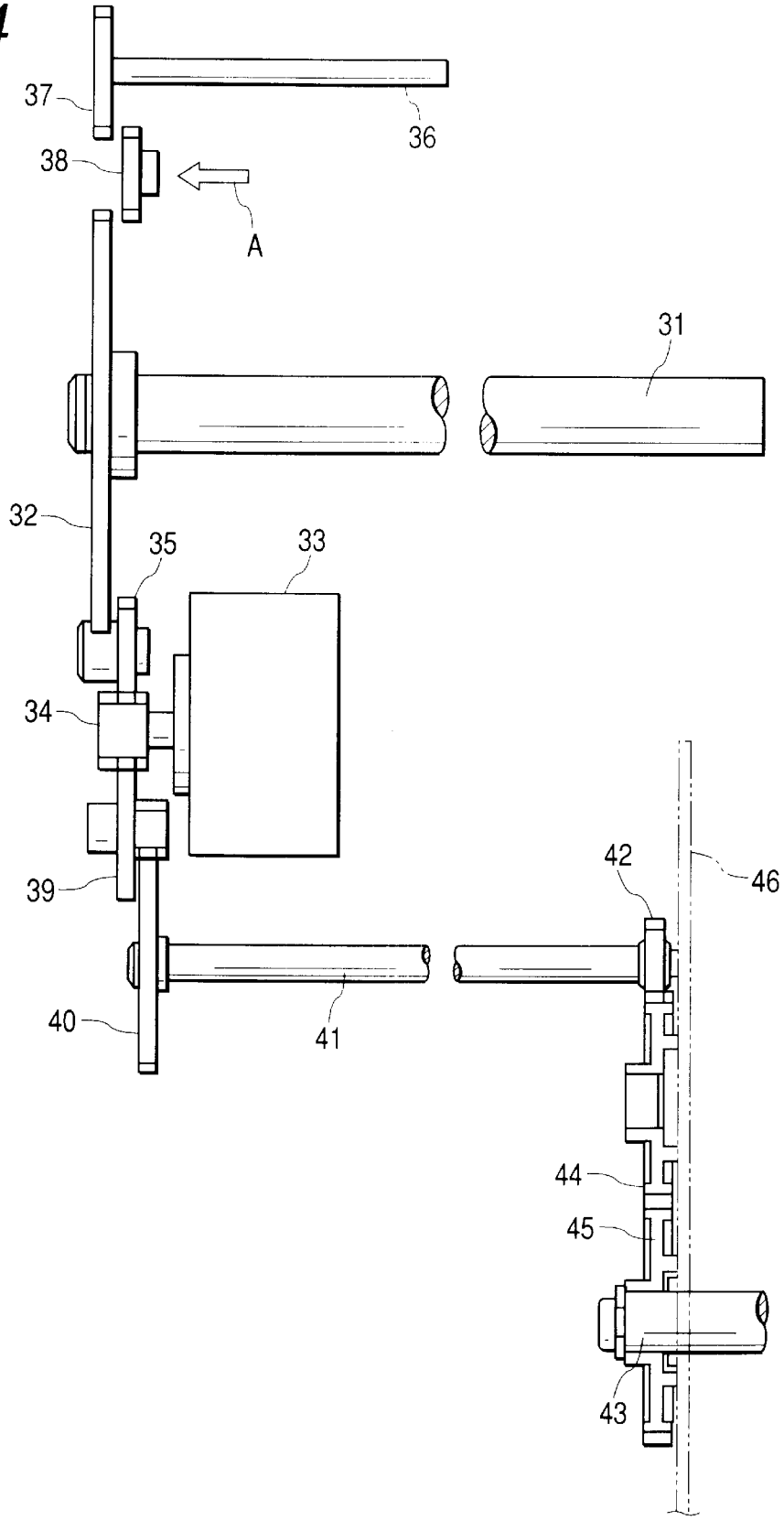
FIG. 4 is a plan view showing a driving force transmission mechanism of a suction pump, a wiping means, etc.

Next, a description is given of a driving force transmission mechanism with respect to the wiping means of the recording head with reference to FIG. 4. FIG. 4 shows an example of the driving force transmitting means for a paper feeding and delivery mechanism, the suction pump and the wiping means, which are attached to the recording apparatus.

In the same drawing, reference number 31 denotes a paper feeding roller. The paper feeding roller 31 is constructed so that a gear 32 is disposed at one end of the paper feeding roller 31 and the same is driven via an idler 35 from a pinion 34 disposed on the shaft of the paper feeding motor 33. A gear 37 is provided at one end of the paper feeding roller drive shaft 36, and a driving force is transmitted to a cut sheet feeder (not illustrated) in engagement with the gear 32 via a movement gear 38 that constitutes a clutch mechanism, whereby recording paper is fed (loaded).

The moving gear 38 is always held at a position apart from both the gears 32 and 37 by a spring (not illustrated) as shown in FIG. 4, and is moved in the axial direction (the direction shown by the arrow "A") by being pressed by the carriage 1 that moves to the end side opposed to the home position, wherein the same is caused to intervene between both the gears 32 and 37 to achieve engagement between both the gears.

On the other hand, a driving force from the paper feeding motor 33 is transmitted to the pinion 34, the idler 35 and paper delivery gear 40 on the paper delivery roller 41, and further a driving force from the paper delivery roller gear 40 is transmitted to a gear 42 on the paper delivery roller 41, an idler 44, and a drive shaft 43 via a driven gear 45, whereby the suction pump is driven. The suction pump is assembled on a plate-made fixing base (pump frame attaching base) 46 in a state where the pump frame (described later) is already mounted. The drive shaft 43 of the suction pump is rotatably and pivotally supported on the fixing base 46 and pump frame (described later).

Figure 5:
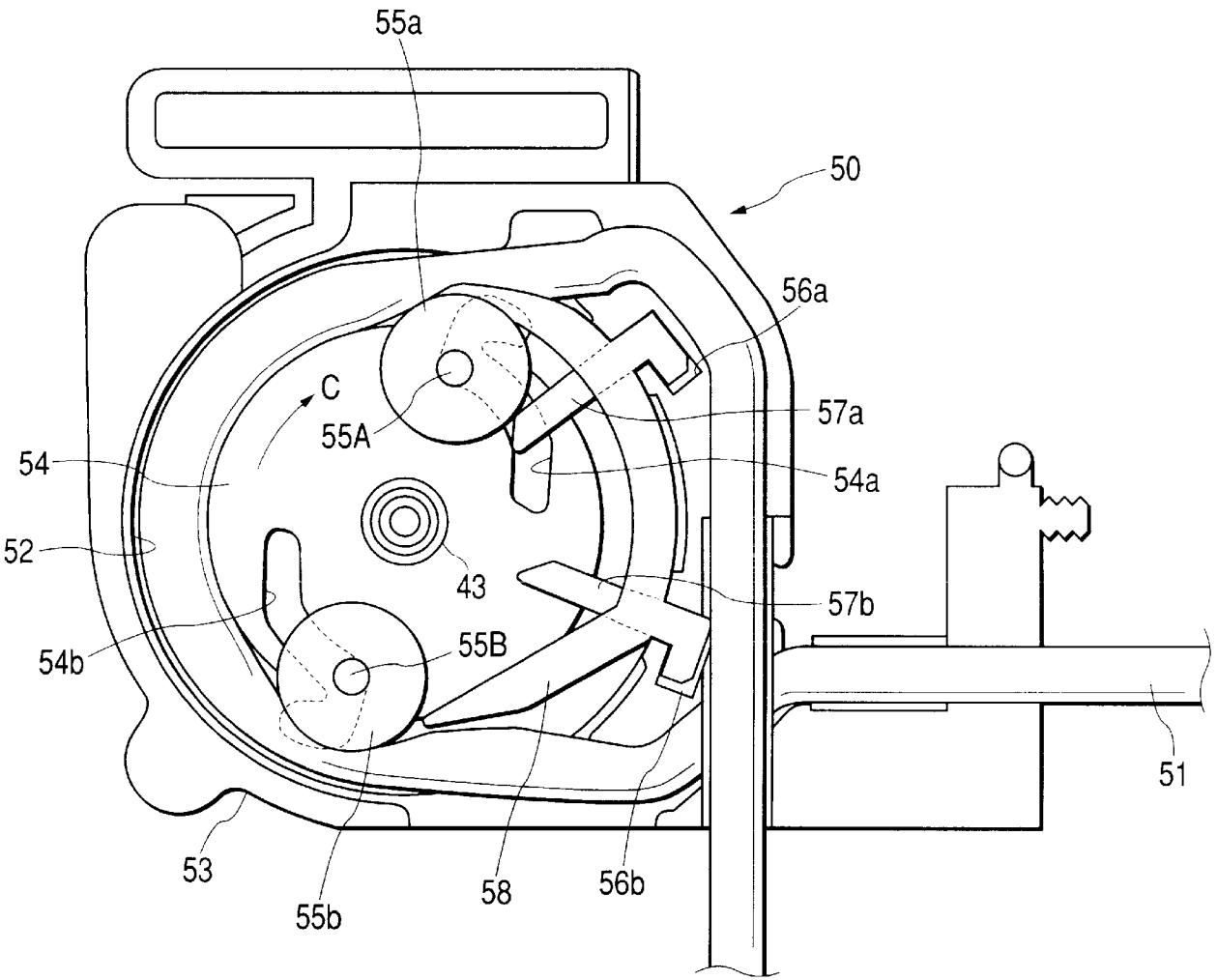
FIG. 5 is a perspective view showing a state where a roller presses and deforms a flexible tube by normal rotations of a pump wheel of the suction pump, and a pumping state is brought about.
Figure 6:
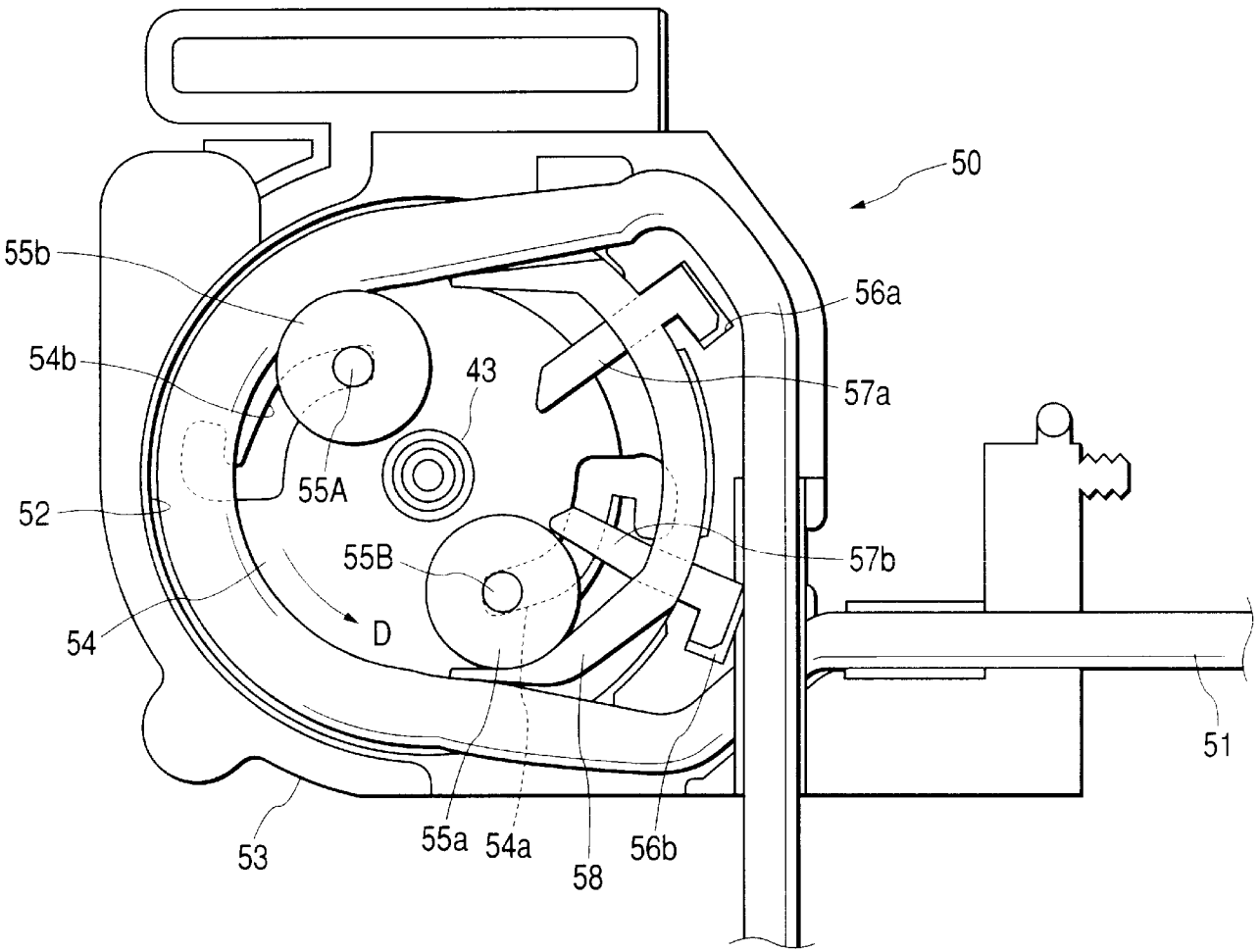
FIG. 6 is a perspective view showing a case where the pump wheel of the suction pump is driven and reversed to bring about a release state.

Next, a description is given of a tube pump that is used as the suction pump, with reference to FIGS. 5 and 6. FIGS. 5 and 6 show an embodiment of the tube pump that is used as the suction pump attached to the recording apparatus. FIG. 5 shows a case where a pumping operation is carried out by normally rotating the tube pump while FIG. 6 shows a case where a release state is brought about by reversing the tube pump.

In FIG. 5 and FIG. 6, the tube pump (suction pump) shown with reference number 50 is provided with a pump frame 53 acting as a fixing base, a pump wheel 54 that is rotated by the drive shaft 43, and rollers 55*a* and 55*b* that are rotated and rolled by rotations of the pump wheel 54.

The pump frame 53 has a tube supporting surface 52 that arcuately regulates the outline of a flexible tube 51, and the pump wheel 54 has a pair of roller supporting grooves 54*a* and 54*b* having such an inclination so as to intercross in the diametrical direction of the wheel between the wheel center portion and the outer circumference of the wheel. The rollers 55*a* and 55*b* have roller shafts 55A and 55B that are movable in the respective roller supporting grooves 54*a* and 54*b*.

In such a tube pump, as shown in FIG. 5, by rotating the pump wheel 54 normally (in the direction shown by the arrow "C"), the respective rollers 55*a* and 55*b* (roller shafts 55A and 55B) are moved to the outer circumference of the wheel of the roller supporting grooves 54*a* and 54*b*, thereby causing the flexible tube 51 to be continuously squashed in the direction of rotation of the wheel.

Therefore, pressure is generated in the flexible tube 51 so that negative pressure is applied in the capping means 6. Ink is forcedly delivered from the recording head 5 by the negative pressure, and simultaneously, ink delivered into the capping means 6 is sent to a discharge tank (not illustrated)

On the other hand, as shown in FIG. 6, by reversing the pump wheel 54 (in the direction shown by the arrow "D"), the respective rollers 55*a* and 55*b* (roller shafts 55A and 55B) are moved to the wheel center portion (the inner circumferential portion of the wheel) of the roller supporting grooves 54*a* and 54*b*, wherein a release state is brought about, in which the respective rollers 55*a* and 55*b* are slightly brought into contact with the flexible tube 51.

Therefore, it is possible to prevent the flexible tube 51 from a failure such as sticking to the respective rollers 55*a* and 55*b*.

In addition, engagement grooves (L-shaped grooves) 56*a* and 56*b* that are used to attach guide members 57*a* and 57*b* and a damper member 58 are provided at a position opposed to the tube supporting surface 52 of the pump frame 53.

The respective guide members 57*a* and 57*b* are formed of a resilient material such as rubber, whereby as the respective rollers 55*a* and 55*b* are brought into contact with the guide members 57*a* and 57*b* in line with rotation of the pump wheel 54, the respective roller shafts 55A and 55B are guided in the direction opposed to the rotation direction of the wheel of the roller supporting grooves 54*a* and 54*b*.

That is, as the pump wheel 54 is normally rotated as shown in FIG. 5, the rollers 55*a* and 55*b* are subjected to an action by which the rollers 55*a* and 55*b* are pushed backward in the opposite direction of the rotation direction of the pump wheel 54 by the guide members 57*a* and 57*b*, and the roller shafts 55A and 55B are moved to the outer circumferential portion of the wheel of the roller supporting grooves 54*a* and 54*b*.

Accordingly, the flexible tube 51 is continuously squashed in the rotation direction of the wheel by the respective rollers 55*a* and 55*b*, wherein the reliability of the pump driving operation can be improved.

On the other hand, as the pump wheel 54 is reversed as shown in FIG. 6, the rollers 55*a* and 55*b* are brought into contact with the guide members 57*a* and 57*b* and are subjected to an action by which the rollers 55*a* and 55*b* are pushed backward. In other words, the rollers 55*a* and 55*b* move to the inner circumferential portion of the wheel of the roller supporting grooves 54*a* and 54*b*, while shifting down the guide members 57*a* and 57*b*, in line with rotations of the pump wheel 54, wherein a pressing and squashing action of the flexible tube 51 is released to bring about a release state.

The damper 58 is disposed at a position opposed to the tube supporting surface 52 in the pump frame 53, and the entirety thereof is formed of an arcuate member made of a resilient material such as rubber. Thereby, the rollers 55*a* and 55*b* are devised so as to be brought into contact with the damper member 58 even if the rollers 55*a* and 55*b* are disengaged from the contacted area with the flexible tube 51, wherein free movement of the rollers 55*a* and 55*b* (roller shafts 55A and 55B) in the roller supporting grooves 54*a* and 54*b* is regulated. In other words, at the moment when deformation of the guide members 57*a* and 57*b* is resiliently returned in line with the movement of the rollers 55*a* and 55*b*, a collision action of the rollers 55*a* and 55*b* against the roller supporting grooves due to flick-out of the guide members 57*a* and 57*b* can be interrupted, and it is possible to prevent impact noise from being generated.

Figure 7:
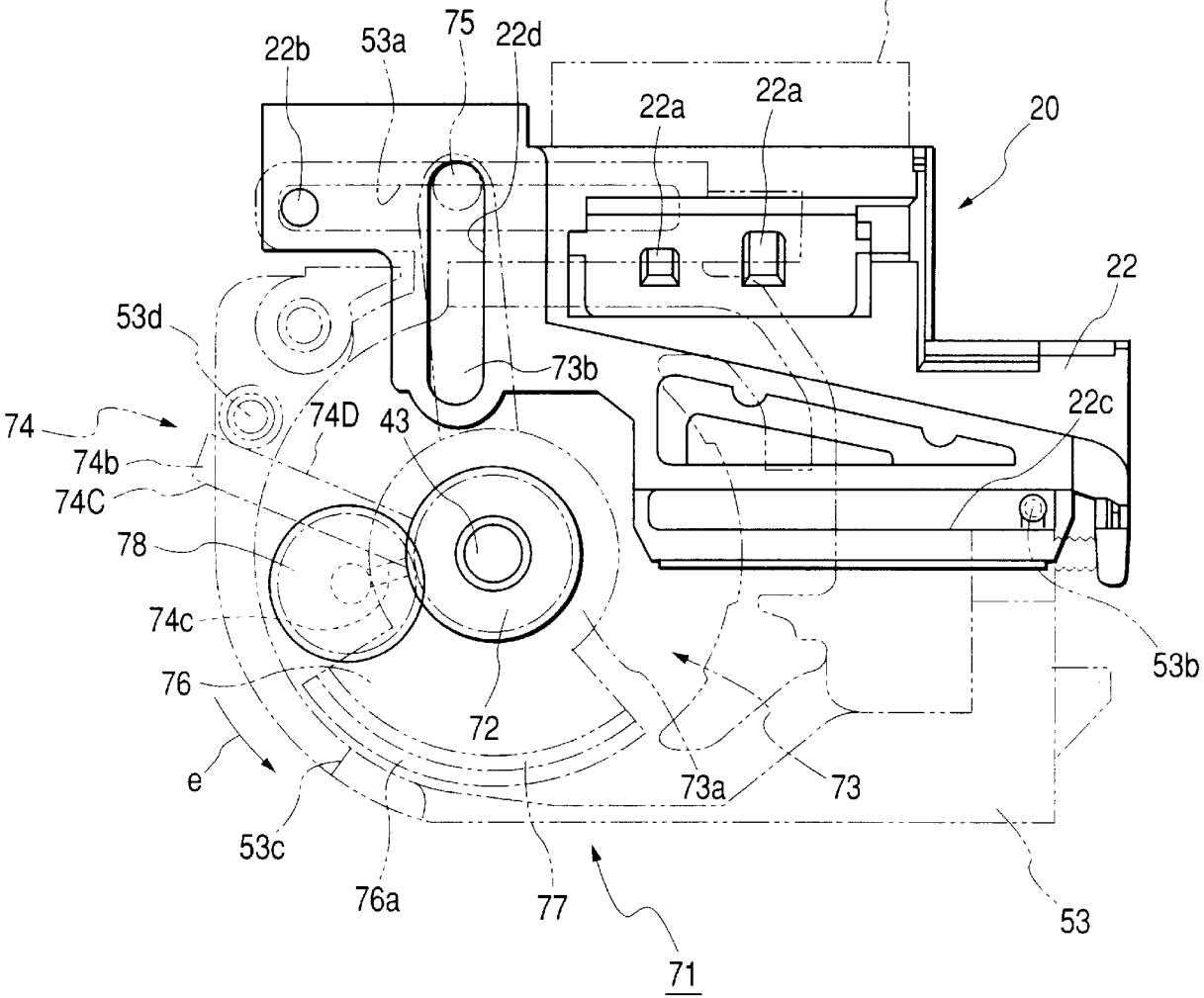
FIG. 7 is a perspective view showing a wiper reset state where the wiping means in an ink jet recording apparatus according to a first embodiment of the invention is retreated from the movement path of the recording head.
Figure 8:
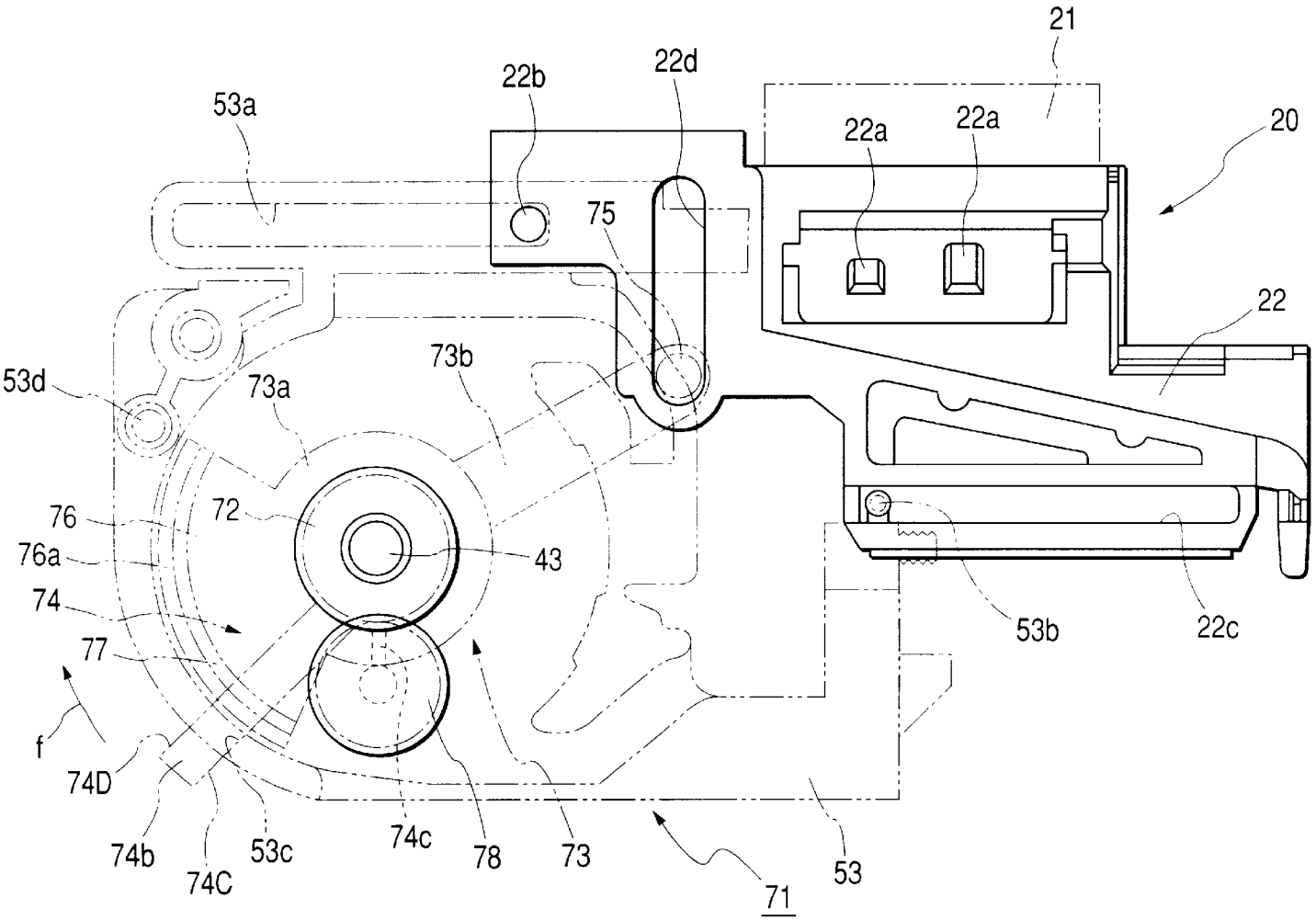
FIG. 8 is a perspective view showing a wiper set state where the wiping means in an ink jet recording apparatus according to the first embodiment of the invention is advanced to the movement path of the recording head.
Figure 9A:
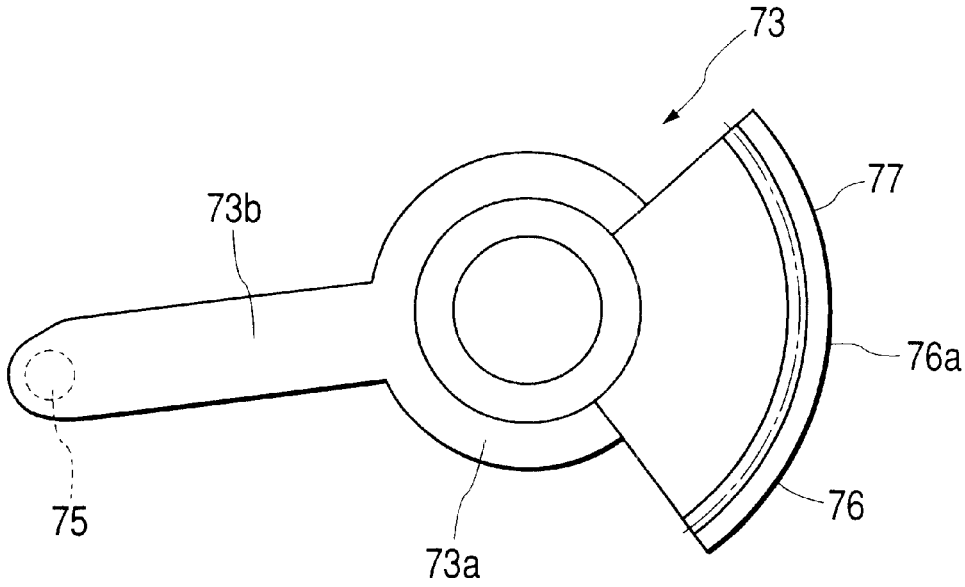
FIGS. 9A and 9B are plan views showing a cleaner drive lever and a gear holding lever of a driving mechanism of the wiping means in the ink jet recording apparatus according to the first embodiment of the invention.
Figure 9B:
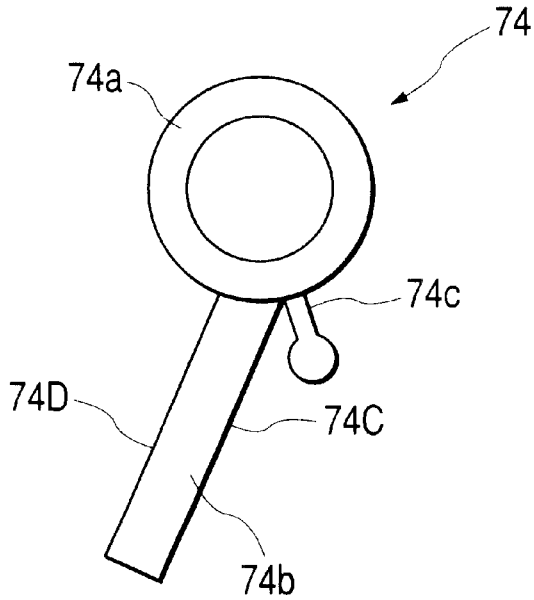

Next, with reference to FIG. 7 through FIG. 9B, a description is given of a driving mechanism of the wiping means that is one of the major parts of the invention. FIG. 7 shows a wiper-reset (cleaner reset) state where the wiping means of an ink jet recording apparatus according to one embodiment of the invention is retreated from the movement path of the recording head. FIG. 8 shows a wiper set (cleaner set) state where the wiping means of an ink jet recording apparatus according to the embodiment of the invention is caused to advance to the movement path of the recording head. FIGS. 9A and 9B show a cleaner drive lever and a gear holding lever of the driving mechanism of the wiping means in the ink jet recording apparatus according to the embodiment of the invention.

In FIG. 7 and FIG. 8, the driving mechanism 71 for the cleaner is disposed between the fixing base 46 and the pump frame 53. The driving mechanism 71 includes the drive shaft (pump shaft) 43 having a sun gear 72, and a cleaner drive lever 73 and a gear holding lever 74, which are positioned at the front and the rear adjacent to each other in the head moving direction of the drive shaft 43.

The cleaner drive lever 73 has an annular base portion 73*a* through which the drive shaft 43 passes, and a tongue-shaped lever portion 73*b* that protrudes toward the base portion 73*a*. The lever 73 is disposed at the non-pump side of the gear holding lever 74, and is rotatably and pivotally supported at the drive shaft 43 in an appointed rotation stroke (a range to satisfy $\theta \leqq 66°$ where it is assumed that the rotation stroke is a rotating angle $\theta$). A columnar drive pin 75 projecting to the pump side (in the horizontal direction) is integrally provided at the lever portion 73*b* of the cleaner drive lever 73. In addition, an extended portion 76, whose plan is fan-shaped, projecting to the side opposed to the lever portion 73*b* and having a rising wall 76*a* on the outer circumferential edge, is integrally disposed on the base portion 73*a* of the cleaner drive lever 73. The rising wall 76*a* of the extended portion 76 is provided with inner teeth 77 along the circumferential direction.

A triangular post-shaped claw portion 22*a* to attach the wiping member 21 and a columnar slide pin 22*b* projecting to the pump side are provided at the upward end of the holder 22 in the cleaner (wiping means) 20. A recessed groove 22*c* extending in a direction (left and right directions) perpendicular to the movement path of the recording head 5 is provided at the downward end portion of the holder 22. A recessed groove 22*d* that vertically extends and guides the drive pin 75 is provided at the holder 22.

At the upward end portion of the pump frame 53, a recessed groove 53*a* that extends in the left and right directions (in the direction perpendicular to the movement path of the recording head 5 and the extending direction of the recessed groove 22*d*) and guides the slide pin 22*b* is provided. A columnar fixing pin 53*b* that projects to the cleaner side and faces the inside of the recessed groove 22*c* is provided at the head movement path side of the pump frame 53. In addition, at the downward end portion of the pump frame 53, two juxtaposed stoppers 53*c* and 53*d* that correspond to two rotation stop positions of a gear holding lever 74 (described later) and have appointed spacing in the circumferential direction are provided.

The gear holder lever 74 has an annular base portion 74*a* through which the drive shaft 43 passes, and rectangular lever portions 74*b* and 74*c* that projects in the radial direction of the base portion 74*a*, and is rotatably and pivotally supported at the drive shaft 43 between two rotation stop positions. Stopper engaging portions 74C and 74D that are engageable with both the stoppers 53*c* and 53*d* are provided at the lever portion 74*b* of the gear holding lever 74. In addition, a planet gear 78 that is engageable with the inner teeth 77 of the cleaner drive lever 73 is rotatably and pivotally held at the lever portion 74*c* in engagement with the sun gear 72. At the gear holding lever 74, at least the lever portion 74*c* of both the lever portions 74*b* and 74*c* is so constructed as to be resiliently deformed upon receiving an external force due to rotation of the cleaner drive lever 73 in a state where the respective stopper engaging portions 74C and 74D are engaged with the respective stoppers 53*c* and 53*d*, wherein when the gear holding lever 74 stops rotating and the cleaner drive lever 73 turns, an impact due to engagement of the planet gear 78 with the inner teeth 77 can be absorbed.

In the above construction, as the sun gear 72 (drive shaft 43) starts rotation in the normal direction (counterclockwise direction) from the wiper reset state shown in FIG. 7, the rotation force is transmitted to the gear holding lever 74 via the planet gear 78, and the gear holding lever 74 rotates counterclockwise (in the direction shown by the arrow "e").

In this case, as the gear holding lever 74 rotates in the direction shown by the arrow "e", the stopper engaging portion 74D is separated from the stopper 53*d*.

In addition, since engagement of the planet gear 78 with the inner teeth 77 is released in a state where the sun gear 72 starts rotation, the cleaner drive lever 73 does not receive any driving force from the sun gear 72, and the same continuously stops at the rotation start position as shown in FIG. 7.

The drive pin 75 and slide pin 22*b* are, respectively, positioned at the starting point (the upper end portion) of the recessed groove 22*d* and the starting point (the left end portion) of the recessed groove 53*a*, and the fixing pin 53*b* is positioned at the starting point (the right end portion) of the recessed groove 22*c*.

Figure 10:
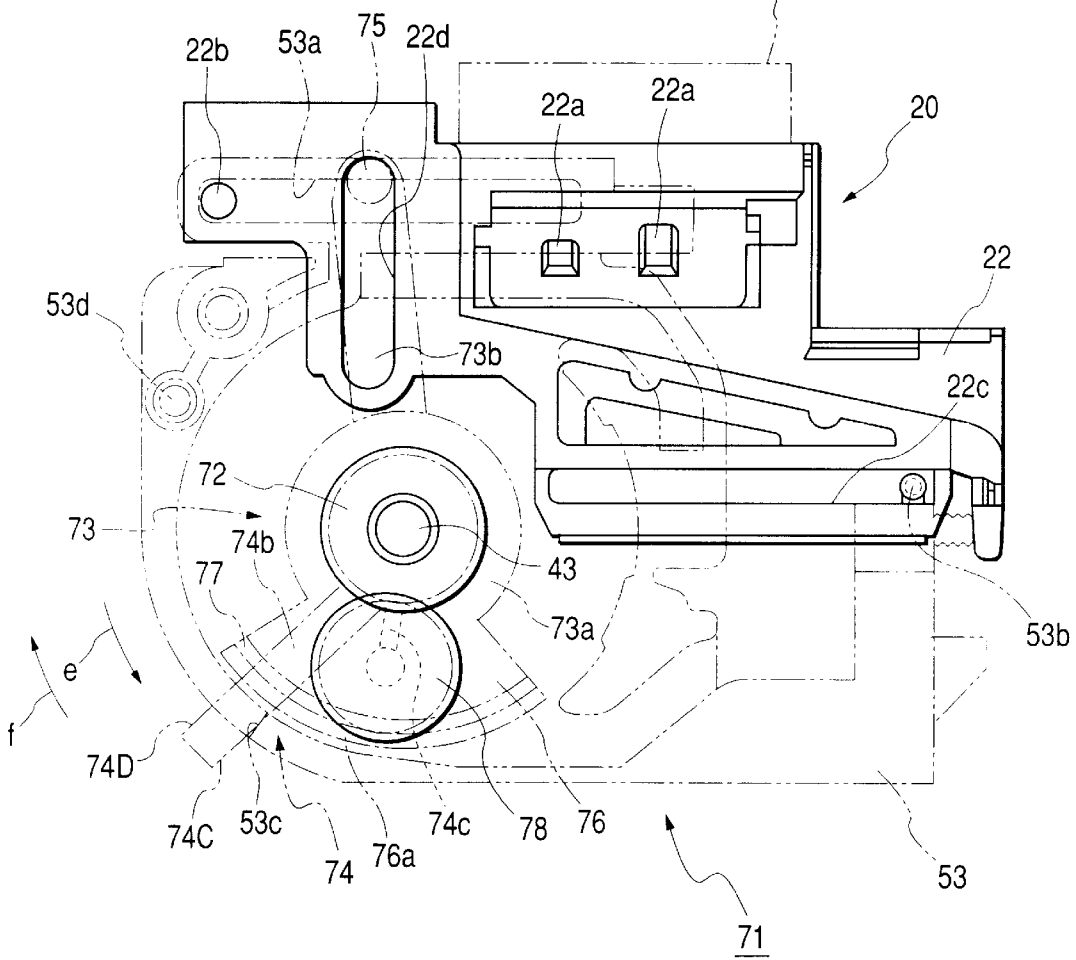
FIG. 10 is a perspective view showing a wiper set starting state.

As the sun gear 72 further rotates counterclockwise, the gear holding lever 74 further rotates in the direction shown by the arrow "e", thereby causing the stopper engaging portion 74C to be engaged with the stopper 53*c* as shown in FIG. 10, and the stopper engaging portion 74C is disposed at the rotation stop position at one side.

In this case, as the gear holding lever 74 rotates in the direction shown by the arrow "e", the planet gear 78 rolls on the inner teeth 77 while being mated with the inner teeth 74 and rotating clockwise. For this reason, the cleaner drive lever 73 does not rotate in the direction shown by the arrow "if" (that is, in the direction for causing the cleaner 20 to advance) until the stopper engaging portion 74*c* is engaged with the stopper 53*c*.

Figure 11:
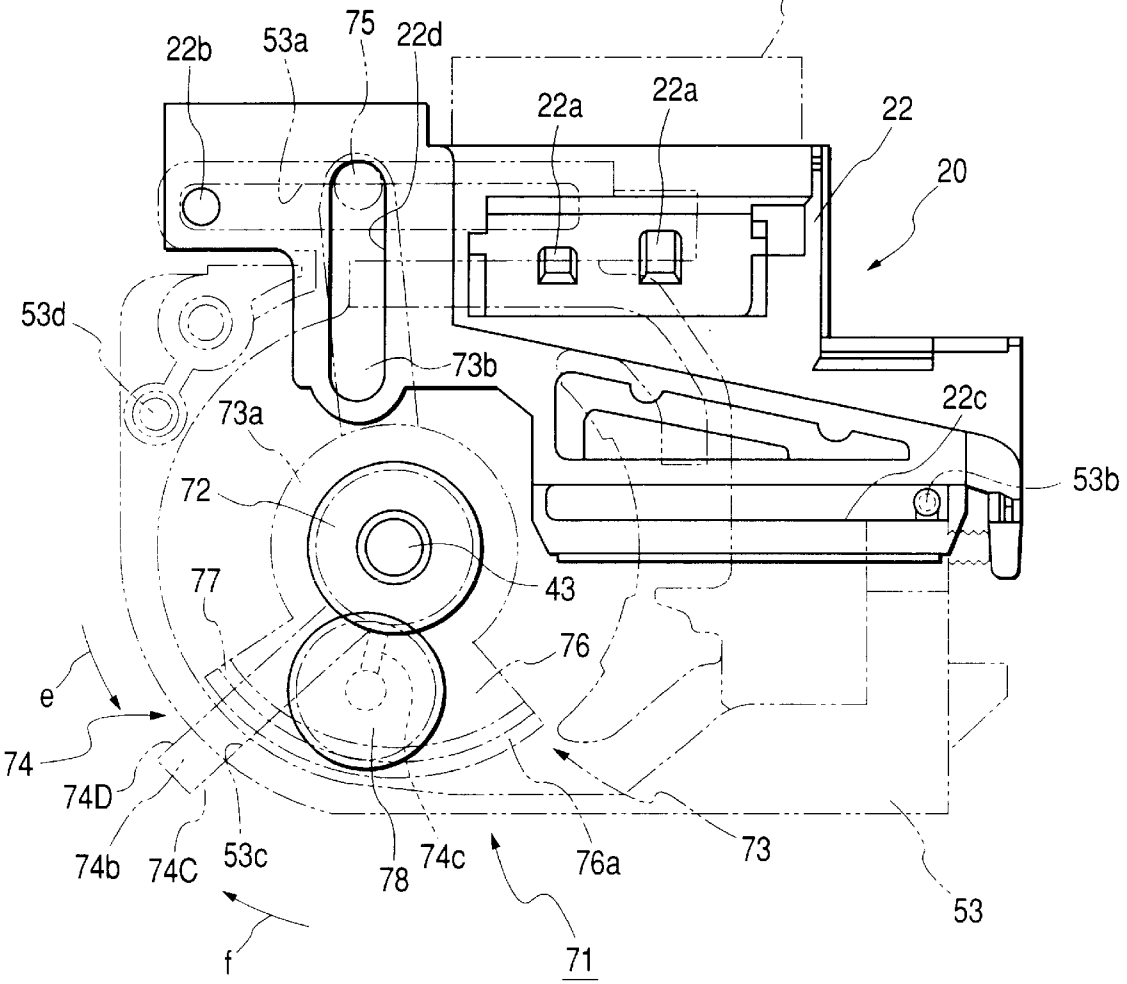
FIG. 11 is a perspective view showing a wiper set starting state (loaded state)

In this state, that is, in a state where the stopper engaging portion 74C is engaged with the stopper 53*c*, if the sun gear 72 further rotates counterclockwise, the planet gear 78 rotates clockwise as shown in FIG. 11, and the cleaner drive lever 73 starts clockwise rotation (in the direction shown by the arrow "f").

In this case, although a rotation force from the sun gear 72 is transmitted to the gear holding lever 74 via the planet gear 78, since the stopper engaging portion 74C of the lever portion 74*b* is engaged with the stopper 53*c*, the gear holding lever 74 does not rotate counterclockwise (in the direction shown by the arrow "e").

Therefore, as a rotation force from the sun gear 72 is transmitted to the gear holding lever 74 via the planet gear 78, the lever portion 74*c* bends in a direction approaching the lever portion 74*b* as shown in FIG. 11.

Figure 12:
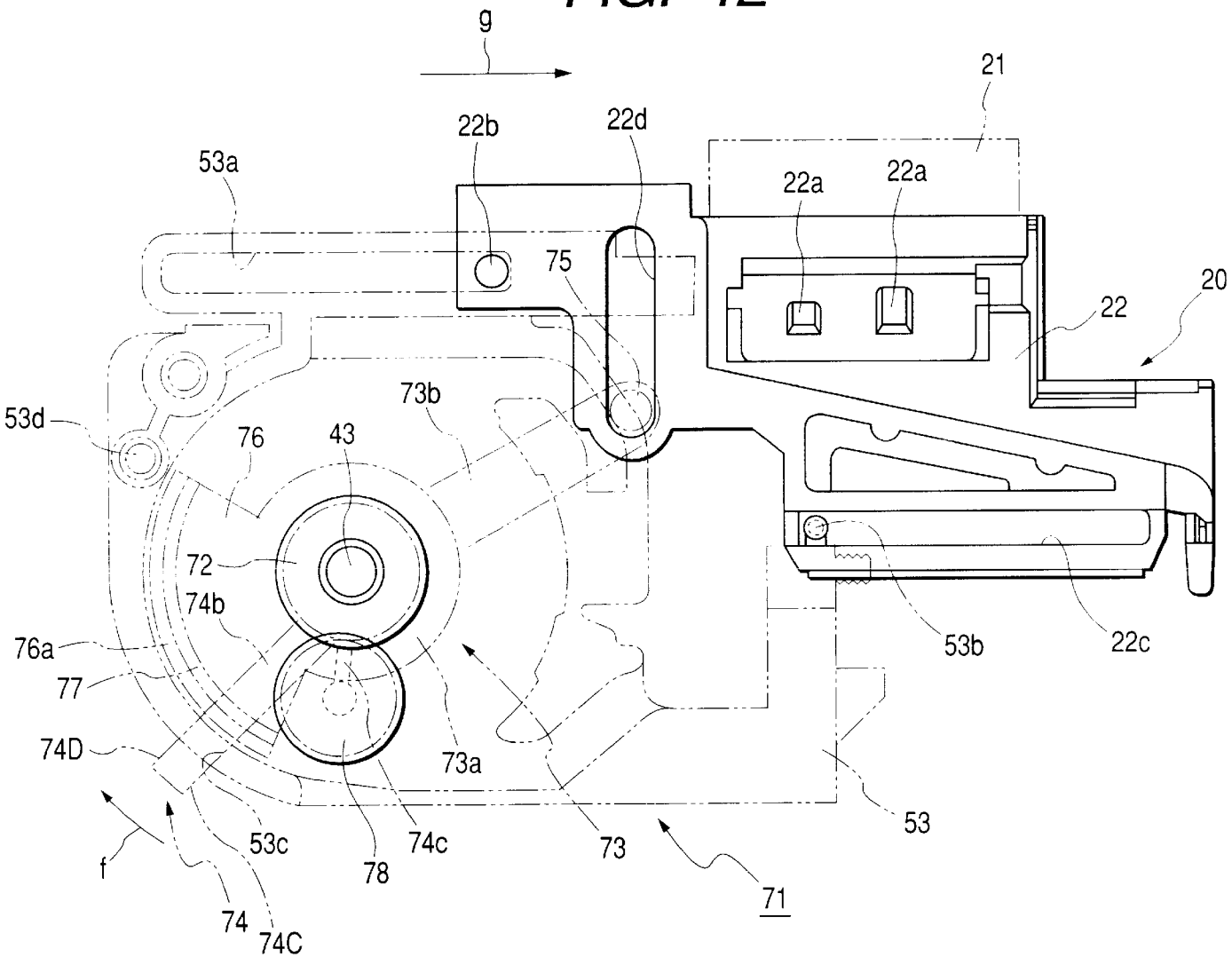
FIG. 12 is a perspective view showing a wiper set terminating state.

As the sun gear 72 further rotates counterclockwise, the planet gear 78 further rotates clockwise as shown in FIG. 12, and the cleaner drive lever 73 rotates in the direction shown by the arrow "f".

In this case, the cleaner 20 moves in the direction shown by the arrow "g" and advances from the outside of the movement path of the recording head 5 to the inside of the movement path thereof, wherein the nozzle forming surface is wiped off in line with movement of the recording head 5.

As the cleaner 20 advances into the movement path of the recording head 5 (that is, the cleaner drive lever 73 rotates clockwise by 66° from the rotation start position), the lever portion 74*c* of the gear holding lever 74 is resiliently reset as shown in FIG. 8, wherein engagement of the planet gear 78 with the inner teeth 77 is released. Therefore, the cleaner drive lever 73 does not receive any driving force from the sun gear 72, and is disposed at the rotation end position.

The drive pin 75 moves from the starting point (the upper end portion) of the recessed groove 22*d* and is positioned at the termination portion (the lower end portion), and simultaneously, the slide pin 22*b* moves from the starting point (the left end portion) of the recessed groove 53*a* and is positioned at the termination portion (the right end portion). The fixing pin 53*b* is positioned at the termination end portion (the left end portion) of the recessed groove 22*c*.

On the other hand, as the sun gear 72 (the drive shaft 43) is reversed (clockwise) from the wiper set state shown in FIG. 8, the rotation force thereof is transmitted to the gear holding lever 74 via the planet gear 78 to cause the gear holding lever 74 to rotate clockwise (in the direction shown by the arrow "f").

In this case, as the gear holding lever 74 rotates in the direction shown by the arrow "f", the stopper engaging portion 74C is separated from the stopper 53*c*.

Since the planet gear 78 is disengaged from the inner teeth 77 in the rotation start state of the sun gear 72, the cleaner drive lever 73 does not receive any driving force from the sun gear 72 and remains as it is stopped at the rotation end position as shown in FIG. 8.

In addition, the drive pin 75 and slide pin 22*b* are, respectively, positioned at the terminating point (the lower end portion) of the recessed groove 22*d* and the terminating point (the right end portion) of the recessed groove 53*a*, and simultaneously, the fixing pin 53*b* is positioned in the terminating point (the left end portion) of the recessed groove 22*c*.

Figure 13:
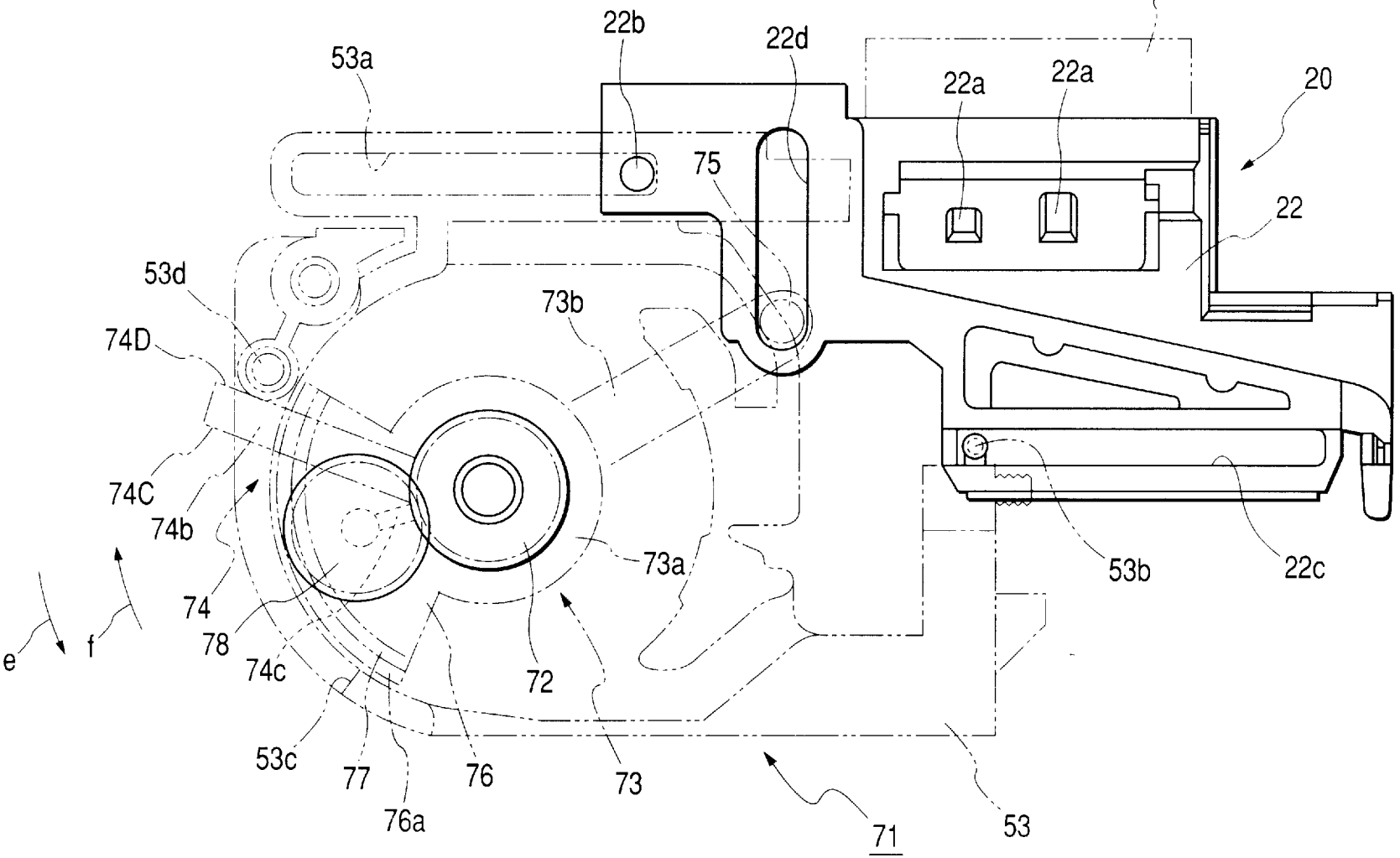
FIG. 13 is a perspective view showing a wiper reset starting state.

As the sun gear 72 further rotates clockwise, the gear holding lever 74 further rotates in the direction shown by the arrow "f" to cause the stopper engaging portion 74D to be engaged with the stopper 53*d* as shown in FIG. 13, and is locked at the rotation stop position at the other side.

In this case, as the gear holding lever 74 rotates in the direction shown by the arrow "f", the planet gear 78 rolls on the inner teeth 77 while being mated with the inner teeth 77 and rotating counterclockwise. Accordingly, the cleaner drive lever 73 does not rotate in the direction shown by the arrow "e" (in the direction of causing the cleaner 20 to retreat) until the stopper engaging portion 74D is engaged with the stopper 53*d*.

Figure 14:
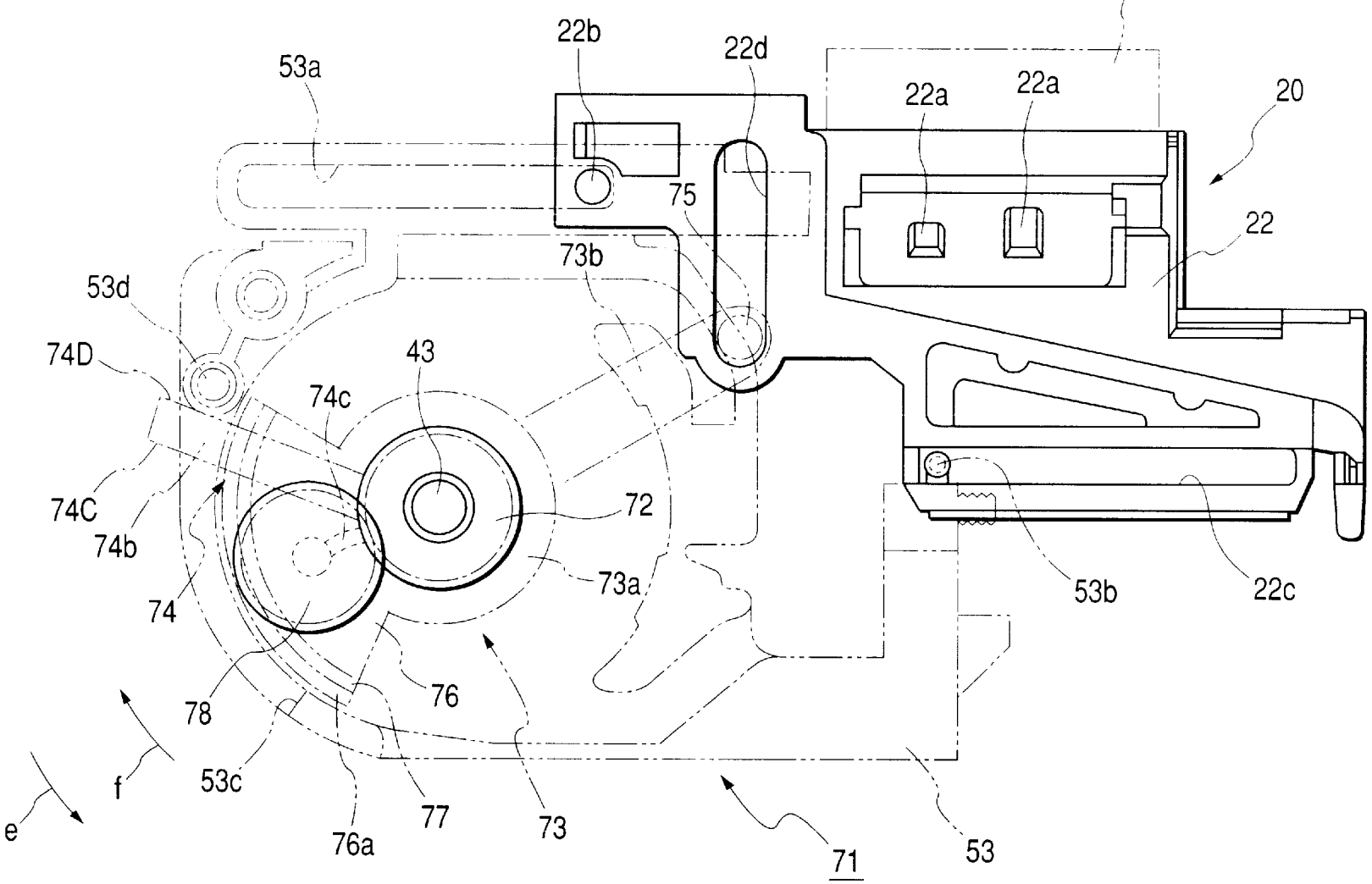
FIG. 14 is a perspective view showing a wiper reset starting state (loaded state)

If the sun gear 72 further rotates clockwise in this state, that is, in a state where the stopper engaging portion 74D is engaged with the stopper 53*d*, the planet gear 78 rotates counterclockwise as shown in FIG. 14, and the cleaner drive lever 73 starts counterclockwise rotation (that is, in the direction shown by the arrow "e").

In this case, a rotation force from the sun gear 72 is transmitted to the gear holding lever 74 via the planet gear 78. However, since the stopper engaging portion 74D of the lever portion 74*b* is engaged with the stopper 53*d*, the gear holding lever 74 does not rotate in the direction shown by the arrow "f".

Accordingly, as the rotation force from the sun gear 72 is transmitted to the gear holding lever 74 via the planet gear 78, the lever portion 74*c* bends so that the same lever portion 74*c* is separated from the lever portion 74*b*.

Figure 15:
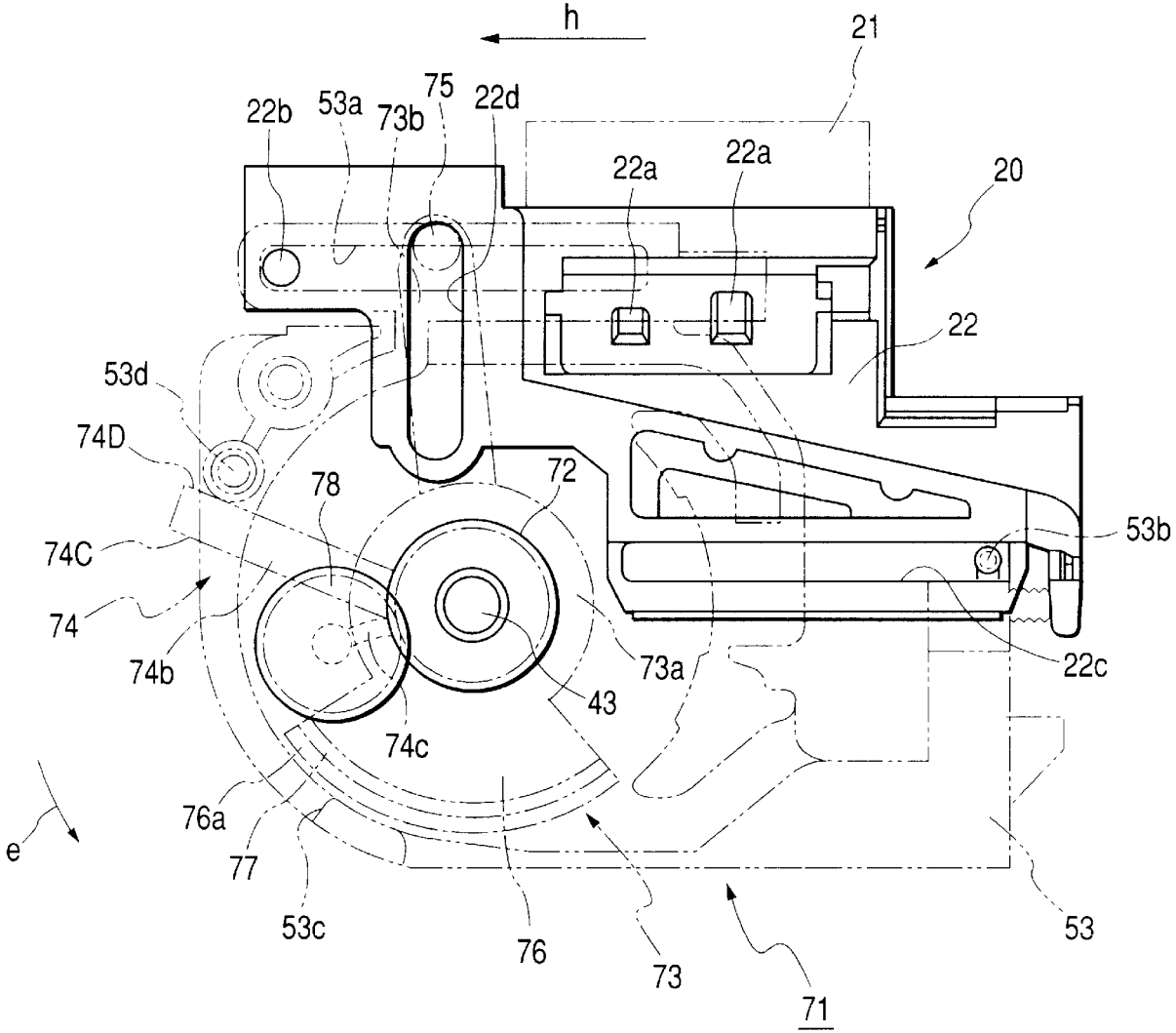
FIG. 15 is a perspective view showing a wiper reset terminating state.

As the sun gear 72 further rotates clockwise, the planet gear 78 rotates counterclockwise as shown in FIG. 15, and the cleaner drive lever 73 rotates in the direction shown by the arrow "e".

In this case, the cleaner 20 moves in the direction shown by the arrow "h", and retreats from the inside of the movement path of the recording head 5 to the outside thereof.

If the cleaner 20 retreats outside the movement path of the recording head 5 (that is, the cleaner drive lever 73 rotates counterclockwise by 66° from the rotation end position), the lever portion 74*c* of the gear holding lever 74 is resiliently reset as shown in FIG. 7, and the planet gear 78 is disengaged from the inner teeth 77. Therefore, the cleaner drive lever 73 is not subjected to a driving force from the sun gear 72 and is disposed at the rotation start position.

Herein, if the cleaner 20 is separated from the recording head 5 by its retreating action, the recording head 5 moves from the cleaner position to the printing area side. That is, the planet gear 78 is disengaged from the inner teeth 77 immediately before the recording head 5 passes through the cleaning position in the movement path, and the cleaning operation is terminated.

In addition, the drive pin 75 moves from the terminating point (the lower end portion) of the recessed groove 22*d* and is positioned at the starting point (the upper end portion), and simultaneously, the slide pin 22*b* moves from the terminating point (the right end portion) of the recessed groove 53*a* and is positioned at the starting point (the left end portion). The fixing pin 53*b* is positioned at the starting point (the right end portion) of the recessed groove 22*c*.

Therefore, in the present embodiment, since transmission of a driving force from the drive shaft 43 to the cleaner 20 and interruption thereof are carried out by engagement of the planet gear 78 with the inner teeth 77 and disengagement thereof, it is possible to terminate a cleaning operation by disengaging the planet gear 78 from the inner teeth 77 immediately before the recording head 5 passes through the advancing position (the cleaner position) of the cleaner 20 in the movement path, wherein it is possible to prevent ink from being adhered to the driving mechanism for the capping means due to splashing of ink.

Therefore, smooth movement of the driving mechanism for the capping means is not hindered, wherein it is possible to increase the reliability in regard to operations of the capping means.

Further, in the embodiment, since a driving force from the drive shaft 43 is transmitted to the cleaner 20 by engagement of the planet gear 78 with the inner teeth 77, it is possible to securely obtain smooth movement of the cleaner 20, and reliability can be increased with respect to the operations of the cleaner. In addition, it is possible to prevent printing from being disordered where the drive source of the cleaner 20 is a paper feeding motor.

Still further, in the embodiment, if the planet gear 78 is disengaged from the inner teeth 77, pump load can be relieved where the drive shaft for advancing and retreating the cleaner is commonly used as the pump shaft (drive shaft 43) of the ink suction pump 50, and durability of the pump can be increased.

Figure 16:
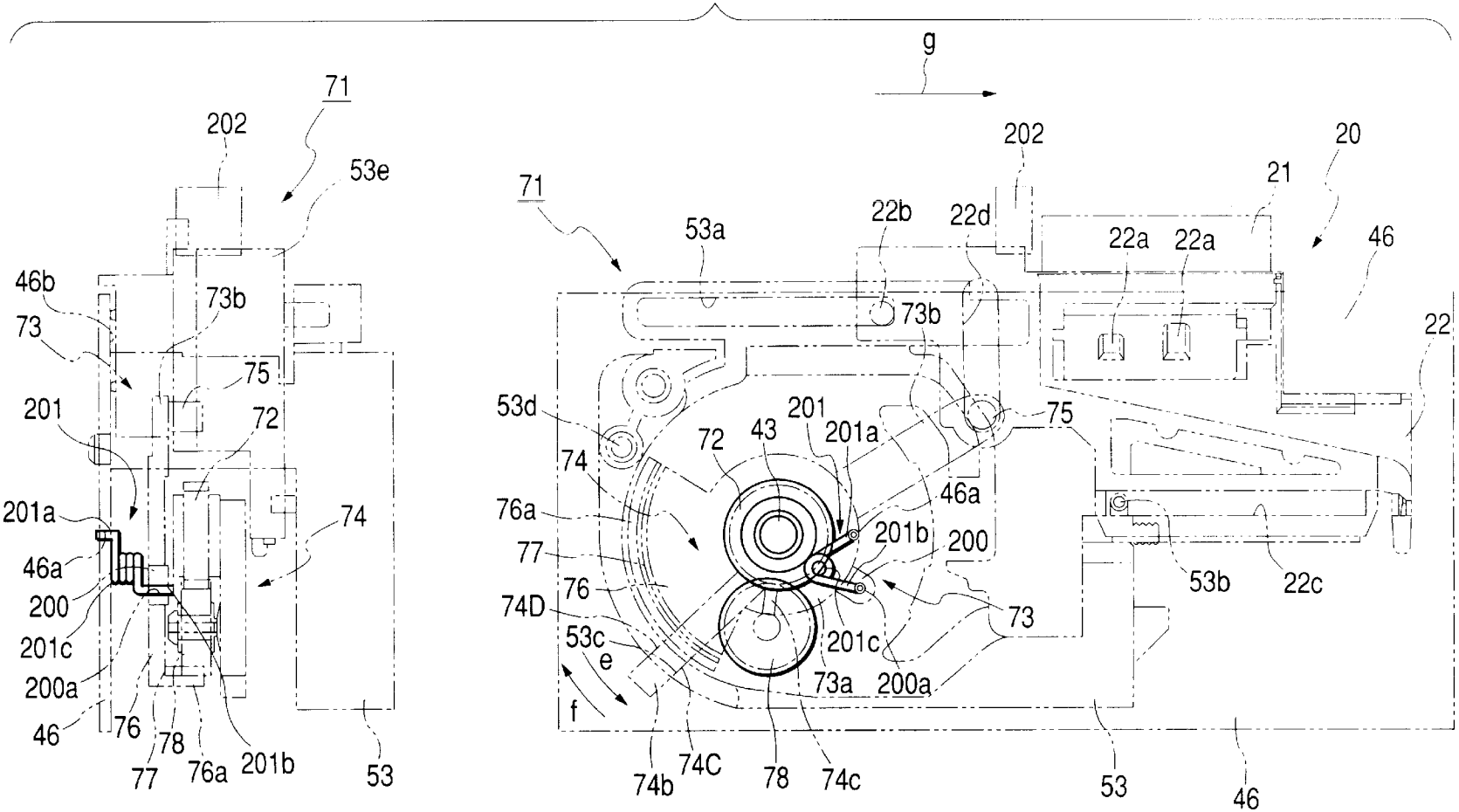
FIG. 16 is a perspective view showing a wiper set state wherein a wiper means in an ink jet recording apparatus according to a second embodiment of the invention is advanced to the movement path of the recording head.
Figure 17:
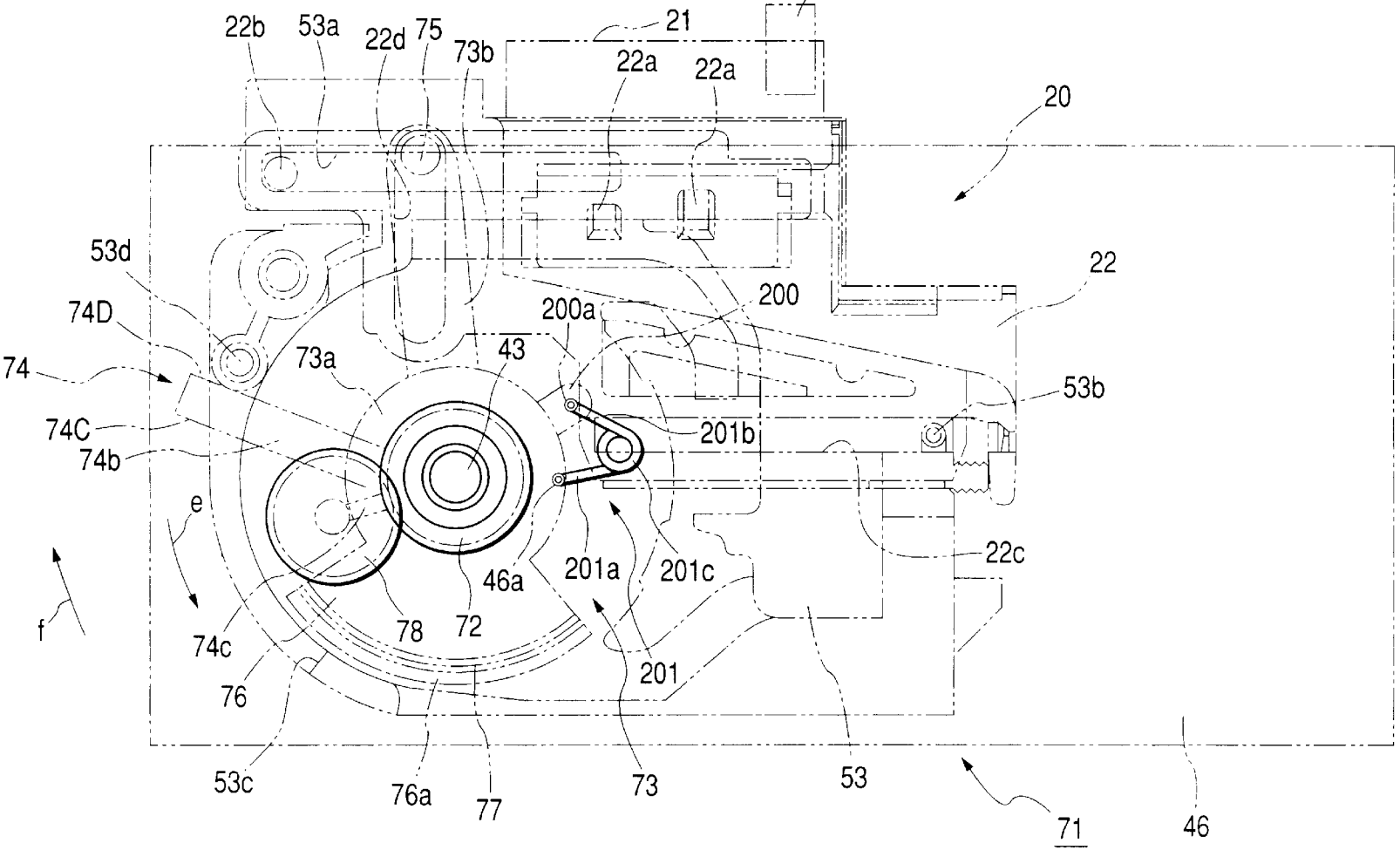
FIG. 17 is a perspective view showing a wiper reset state wherein a wiper means in an ink jet recording apparatus according to a second embodiment of the invention is retreated from the movement path of the recording head.

Next, a description is given of a second embodiment (a driving mechanism of a cleaner) according to the invention with reference to FIGS. 16 and 17. FIG. 16 shows a wiper set state where a wiping means in an ink jet recording apparatus according to the second embodiment of the invention is advanced to the movement path (wiping position) of the recording head. FIG. 17 shows a wiper reset state where a wiping means in the ink jet recording apparatus according to the second embodiment of the invention is retreated from the movement path (wiping position) of the recording head. In the same drawing, parts that are identical to those in FIGS. 7 through 15 are given the same reference numbers, and detailed description thereof is omitted.

In FIGS. 16 and 17, a through hole 46*a* for engagement with a spring, which is open in a direction parallel to the axial direction of the drive shaft 43, is provided on the fixing base 46. A guide surface 46*b* that guides the wiping means (cleaner) 20 in the advancing and retreating directions is provided at the non-printing area side of the fixing base 46, whereby the cleaner 20 is able to carry out stabilized movement of advancing and retreating.

A wiper cleaner 202 that faces the advancing and retreating course of the wiping means (cleaner) 20 is provided at the head moving course side of the pump frame 53 via a rising portion 53*e*. The wiper cleaner 202 is resiliently deformed by a sliding contact of the wiping member (cleaning member) 21 when the cleaner 20 advances and retreats, wherein the ink wiping-off portion (that is, the non-printing area side portion of the wiping member 21) of the wiping member 21 can be cleaned off.

A projection piece 200 having a through hole 200*a* for engagement of a spring, which is open in a direction parallel to the axial direction of the through hole 46*a*, is integrally provided on the base portion 73*a* of the cleaner drive lever 73. The cleaner drive lever 73 receives a repulsion force (a positioning force) of the spring 201 from the same engaging position in line with disengagement of the planet gear 78 from the inner teeth 77, wherein the cleaner 20 is positioned at a wiper set (cleaner set) position or a wiper reset (cleaner reset) position.

The spring 201 is formed of a torsion spring having spring end portions 201*a* and 201*b* having an axial line parallel to the axial line of the drive shaft 43 and a spring winding portion 201*c* that is positioned between both of these spring end portions 201 and 201*b*. The same spring 201 is constructed so that a repulsion force, which positions the cleaner drive lever 73 at the cleaner set position and the cleaner reset position, is applied to the cleaner drive lever 73. The spring end portion 201*a* is passed through the through hole 46*a* and engaged therein, and the spring 201*b* is passed through the through hole 200*a* and is engaged therein. The spring winding portion 201*c* has an axial line parallel to the axial line of both of these spring end portions 201*a* and 201*b*, and is disposed between the fixing base 46 and the cleaner drive lever 73.

The repulsion force of the spring 201 is set to such an intensity that smooth rotations of the cleaner drive lever 73 are not interrupted when the cleaner 20 advances and retreats.

In the above-described construction, the cleaner set operation and cleaner reset operation are carried out as shown below;

Cleaner Set Operation

As the sun gear 72 (the drive shaft 43) starts rotation in a normal direction (that is, counterclockwise) from the wiper reset state shown in FIG. 17, the rotation force is transmitted to the gear holding lever 74 via the planet gear 78, wherein the gear holding lever 74 rotates counterclockwise (that is, in the direction shown by the arrow "e").

In this case, as the gear holding lever 74 rotates in the direction shown by the arrow "e", the stopper engaging portion 74D is separated from the stopper 53*d*.

Since the planet gear 78 is disengaged from the inner teeth 77 in a rotation start state of the sun gear 72, the cleaner drive lever 73 does not receive any driving force from the sun gear 72, but receives a positioning force (a repulsion force), which is brought about by the spring 201, counterclockwise (in the direction shown by the arrow "e") from the spring end portion 201*b*, wherein, as shown in FIG. 17, the cleaner drive lever 73 remains as it is stopped at the rotation start state.

The drive pin 75 and the slide pin 22*b* are, respectively, positioned at the starting point (the upper end portion) of the recessed groove 22*d* and at the starting point (the left end portion) of the recessed groove 53*a*, and simultaneously, the fixing pin 53*b* is positioned at the starting point (the right end portion) of the recessed groove 22*c*.

As the sun gear 72 further rotates counterclockwise, the gear holding lever 74 further rotates in the direction shown by the arrow "e" to cause the stopper engaging portion 74C to be engaged with the stopper 53*c*, and the gear holding lever 74 is locked at the rotation stop position at one side.

In this case, as the gear holding lever 74 rotates in the direction shown by the arrow "e", the planet gear 78 rolls on the inner teeth 77 while being mated with the inner teeth 77 and rotating clockwise. Accordingly, the cleaner drive lever 73 does not rotate in the direction shown by the arrow "f" (in the direction for causing the cleaner 20 to advance) until the stopper engaging portion 74C is engaged with the stopper 53*c*.

Figure 18:
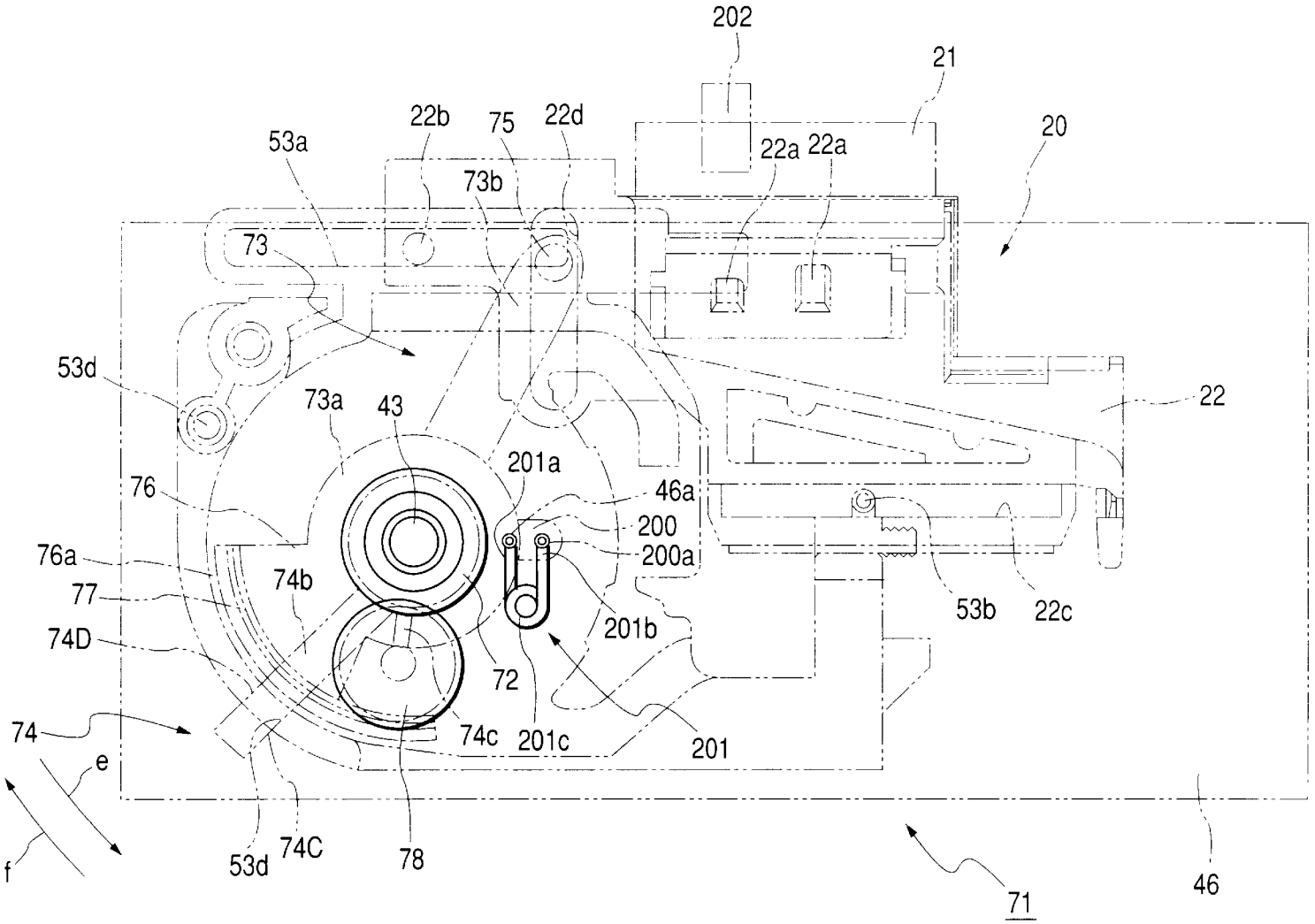
FIG. 18 is a perspective view describing the wiper set starting state.

If the sun gear 72 further rotates counterclockwise in this state, that is, in a state where the stopper engaging portion 74C is engaged with the stopper 53*c*, the planet gear 78 rotates clockwise as shown in FIG. 18, and the cleaner drive lever 73 starts rotation clockwise (in the direction shown by the arrow "f") again the repulsion force of the spring 201.

In this case, since the stopper engaging portion 74C of the lever portion 74*b* is engaged with the stopper 53*c* although the rotation force from the sun gear 72 is transmitted to the gear holding lever 74 via the planet gear 78, the gear holding lever 74 does not rotate counterclockwise (that is, in the direction shown by the arrow "e").

Accordingly, the rotation force from the sun gear 72 is transmitted to the gear holding lever 74 via the planet gear 78, the lever portion 74*c* bends in the direction approaching the lever portion 74*b*.

As the sun gear 72 further rotates counterclockwise, the planet gear 78 further rotates clockwise as shown in FIG. 16, wherein the cleaner drive lever 73 rotates in the direction shown by the arrow "f".

In this case, as shown in FIG. 16, the cleaner 20 moves in the direction shown by the arrow "g" and advances from the outside of the movement path of the recording head 5 to the inside of the movement path (the cleaning position), wherein the nozzle forming surface can be wiped off in line with movement of the recording head 5.

The wiper cleaner 202 is resiliently deformed by a sliding contact with the cleaning member 21 halfway through advancement of the cleaner 20 (that is, before reaching the wiper set position), and the ink wiping-off portion of the cleaning member 21 is cleaned off.

If the cleaner 20 advances into the movement path of the recording head 5 (that is, as the cleaner drive lever 73 rotates clockwise by 66° from the rotation start position), the lever portion 74*c* of the gear holding lever 74 is resiliently reset, wherein the planet gear 78 is disengaged from the inner teeth 77. Therefore, the cleaner drive lever 73 does not receive any driving force from the sun gear 72, but receives a positioning force (that is, the repulsion force), which is brought about by the spring 201, clockwise (in the direction shown by the arrow "f") from the spring end portion 201*b* and is disposed at the rotation end position.

The drive pin 75 moves from the starting point (the upper end portion) of the recessed groove 22*d* and is positioned at the terminating point (the lower end portion), and simultaneously, the slide pin 22*b* moves from the starting point (the left end portion) of the recessed groove 53*a* and is positioned at the terminating point (the right end portion). The fixing pin 53*b* is positioned at the terminating point (the left end portion) of the recessed groove 22*c*.

Cleaner Reset Operation

As the sun gear 72 (the drive shaft 43) starts reversing (clockwise) from the wiper set state shown in FIG. 16, the rotation force is transmitted to the gear holding lever 74 via the planet gear 78, and the gear holding lever 74 rotates clockwise (in the direction shown by the arrow "f").

In this case, as the gear holding lever 74 rotates in the direction shown by the arrow "f", the stopper engaging portion 74C is separated from the stopper 53*c*.

In addition, since the planet gear 78 is disengaged from the inner teeth 77 in the rotation-start state of the sun gear 72, the cleaner drive lever 73 does not receive any driving force from the sun gear 72, but receives a positioning force (repulsion force), which is brought about by the spring 201, clockwise (in the direction shown by the arrow "f") from the spring end portion 201*b*, wherein the cleaner drive lever 73 remains as it is stopped at the rotation end position.

The drive pin 75 and the slide pin 22*b* are, respectively, positioned at the terminating point (the lower end portion) of the recessed groove 22*d* and the terminating point (the right end portion) of the recessed groove 53*a*, and simultaneously, the fixing pin 53*b* is positioned at the terminating point (the left end portion) of the recessed groove 22*c*.

As the sun gear 72 further rotates clockwise, the gear holding gear 74 further rotates in the direction shown by the arrow "f" to cause the stopper engaging portion 74D to be engaged with the stopper 53*d*, wherein the gear holding lever 74 is locked at the rotation stop position at the other side.

In this case, as the gear holding lever 74 rotates in the direction shown by the arrow "f", the planet gear 78 rolls on the inner teeth 77 while being mated with the inner teeth 77 and rotating counterclockwise. Accordingly, the cleaner drive lever 73 does not rotate in the direction shown by the arrow "e" (that is, in the direction of causing the cleaner 20 to retreat) until the stopper engaging portion 74D is engaged with the stopper 53*d*.

Figure 19:
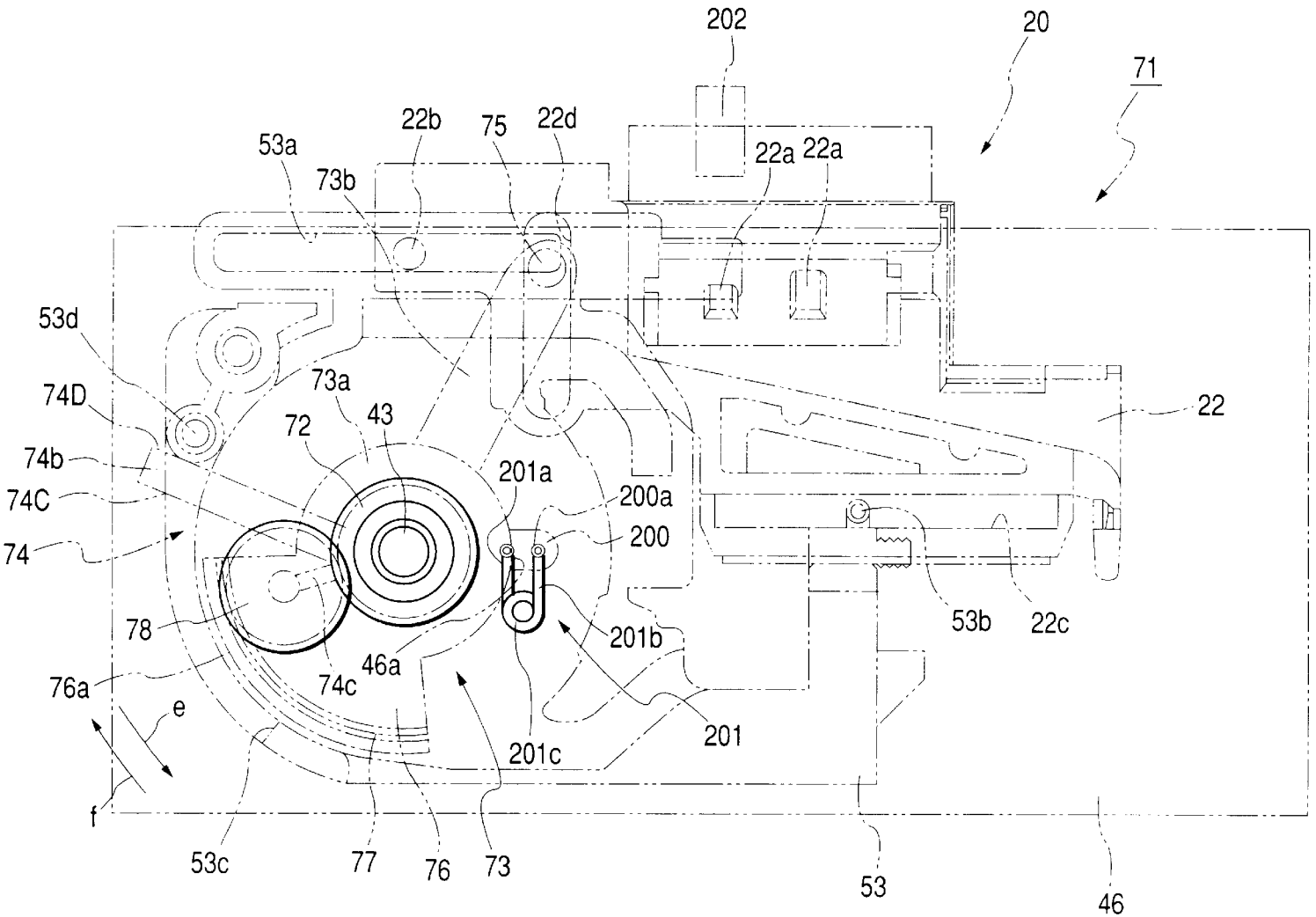
FIG. 19 is a perspective view describing the wiper reset starting state.

If the sun gear 72 further rotates clockwise in this state, that is, in a state where the stopper engaging portion 74D is engaged with the stopper 53*d*, the planet gear 78 rotates counterclockwise as shown in FIG. 19, and the cleaner drive lever 73 starts rotation counterclockwise (that is, in the direction shown by the arrow "e") against the repulsion force of the spring 200.

In this case, the rotation force from the sun gear 72 is transmitted to the gear holding lever 74 via the planet gear 78. However, since the stopper engaging portion 74D of the lever portion 74*b* is engaged with the stopper 53*d*, the gear holding lever 74 does not rotate in the direction shown by the arrow "f".

Accordingly, as the rotation force from the sun gear 72 is transmitted to the gear holding lever 74 via the planet gear 78, the lever portion 74*c* bends in the direction of separating from the lever portion 74*b*.

If the sun gear 72 further rotates clockwise, the planet gear 78 rotates counterclockwise as shown in FIG. 17, and the cleaner drive lever 73 rotates in the direction shown by the arrow "e".

In this case, the cleaner 20 moves in the direction shown by the arrow "h", and retreats from the inside of the movement path of the recording head 5 to the outside thereof.

During advancement of the cleaner 20 (before reaching the wiper reset position), the wiper cleaner 202 is resiliently deformed by a sliding contact with the cleaning member 21, and the ink wiping-off portion of the cleaning member 21 can be cleaned up.

In addition, if the cleaner 20 retreats to the outside of the movement path of the recording head 5 (that is, the cleaner drive lever 73 rotates by 66° counterclockwise from the rotation end position), the lever portion 74*c* of the gear holding lever 74 is resiliently reset, wherein the planet gear 78 is disengaged from the inner teeth 77. Therefore, the cleaner drive lever 73 does not receive any driving force from the sun gear 72, but receives a repulsion force, which is brought about by the spring 202, counterclockwise (that is, in the direction shown by the arrow "e") from the spring end portion 201*b*, and the cleaner drive lever 73 is disposed at the rotation start position.

Herein, as the cleaner 20 is separated from the recording head 5 by a retreating action, the recording head 5 moves from the cleaner position to the printing area side. That is, the planet gear 78 is disengaged from the inner teeth 77 immediately before the recording head 5 passes through the cleaning position in the movement path, wherein the cleaning operation is terminated.

The drive pin 75 moves from the terminating point (the lower end portion) of the recessed groove 22*d* and is positioned at the starting point (the upper end portion), and simultaneously, the slide pin 22*b* moves from the terminating point (the right end portion) of the recessed groove 53*a* and is positioned at the starting point (the left end portion). The fixing pin 53*b* is positioned at the starting point (the right end portion) of the recessed groove 22*c*.

Therefore, since, in the present embodiment, transmission of the driving force from the drive shaft 43 to the cleaner 20 and interruption thereof are carried out by engagement of the planet gear 78 with the inner teeth 77 and disengagement thereof, it is possible to prevent ink from being adhered to the driving mechanism of the capping means due to splashing-out thereof as in the first embodiment, and reliability can be increased with respect to the operation of the capping means.

Further, in the present invention, since a driving force from the drive shaft 43 engages the planet gear 78 with the inner teeth 77 and is transmitted to the cleaner 20, reliability with respect to the operation of the cleaner can be increased, and at the same time, it is possible to prevent printing from being disordered in the case where the drive source of the cleaner 20 is a paper feeding motor.

In the present embodiment, if the planet gear 78 is disengaged from the inner teeth 77, pump load can be relieved in the case where the cleaner advancing and retreating drive shaft is commonly used as the pump shaft (the drive shaft 43) of the ink suction pump 50, and durability of the pump can be increased as in the first embodiment.

In addition thereto, in the present embodiment, since the cleaner drive lever 73 is positioned at the cleaner set and reset positions by a repulsion force of the spring 201, it is possible to prevent the cleaner drive lever 73 from play when positioning the same lever 73, wherein a stabilized cleaning operation can be obtained.

In the embodiment, since it is possible to securely separate the planet gear 78 from the inner teeth 77 at the cleaner set and reset positions by the spring 201, the durability of these components can be increased, and at the same time, it is possible to prevent abnormal noise from occurring due to a collision between the planet gear 78 and the inner teeth 77.

Figure 20:
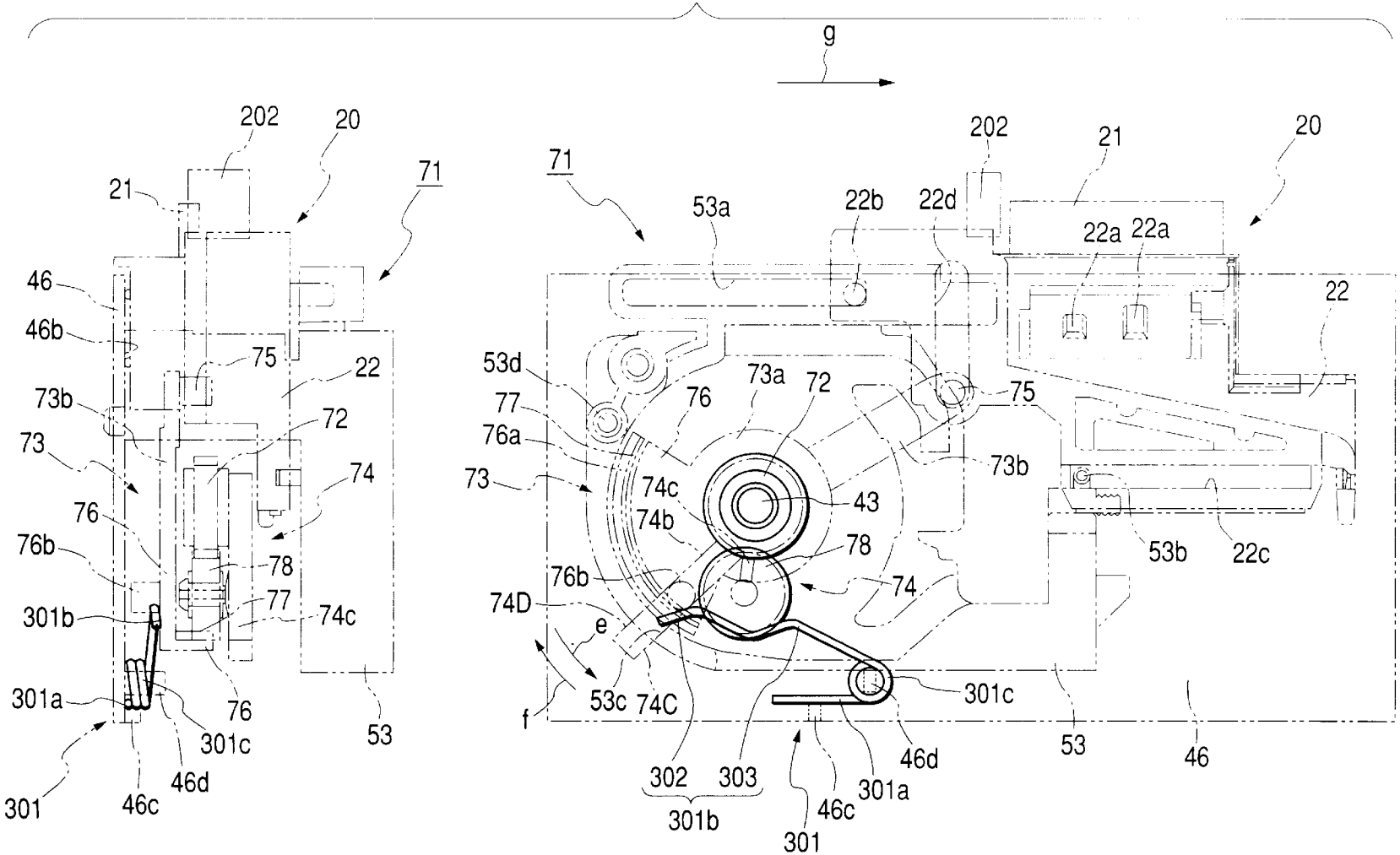
FIG. 20 is a perspective views showing a wiper set state wherein a wiping means in an ink jet recording apparatus according to the second embodiment (modified example) of the invention is advanced to the movement path of the recording head.
Figure 21:
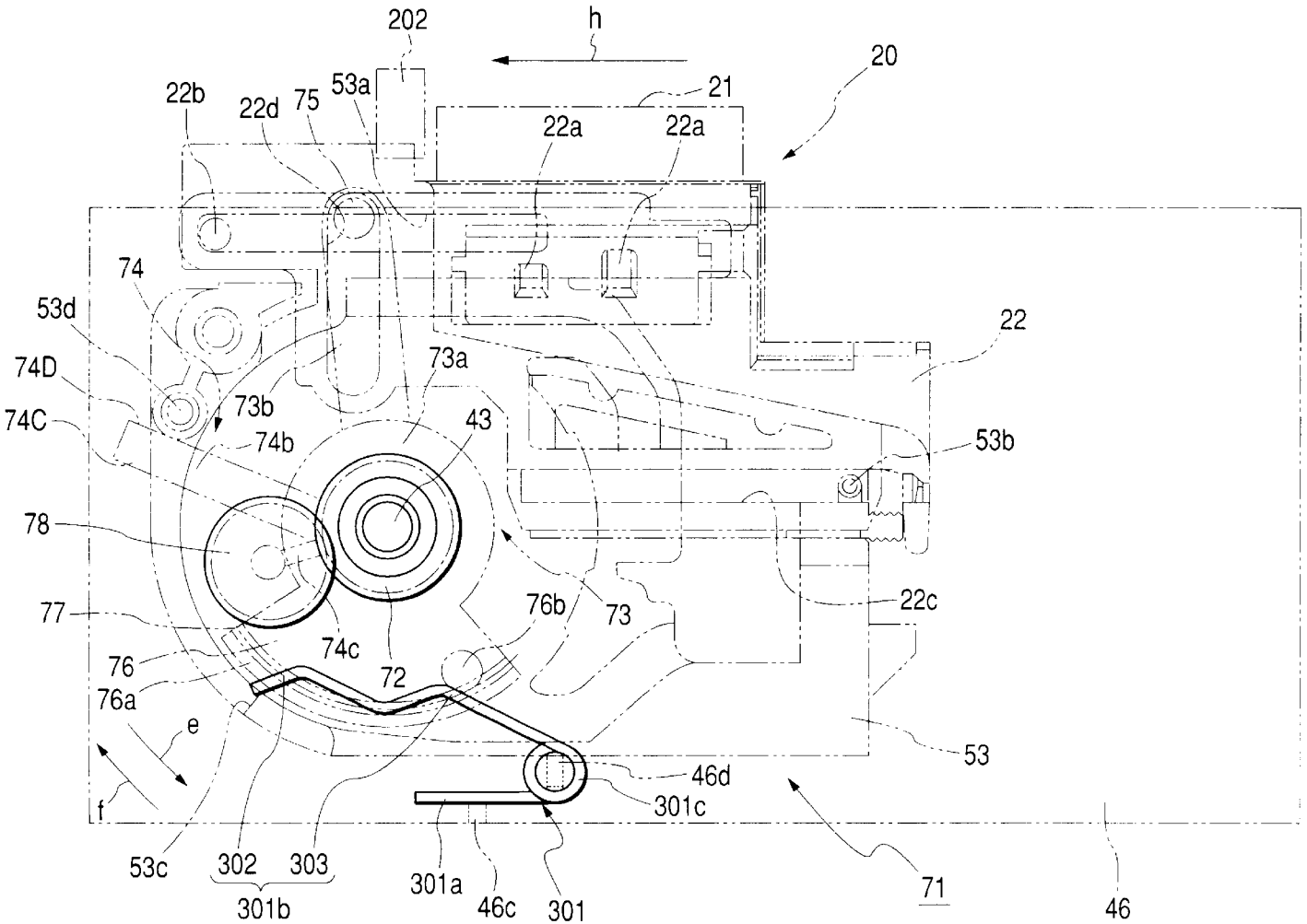
FIG. 21 is a perspective view showing a wiper reset state wherein a wiping means in an ink jet recording apparatus according to the second embodiment (modified example) of the invention is retreated from the movement path of the recording head.

Further, in the second embodiment, a description was given of the case where the engaging positions of the spring 201 with respect to the cleaner drive lever 73 are the same engaging positions at the cleaner set position and the cleaner reset position. However, the present invention is not limited to this case. As shown in FIG. 20 and FIG. 21, in the case (modified example) where the engaging positions differs from each other, effects similar to those of the embodiments can be brought about.

A description is given of the modified example of the second embodiment with reference to the same drawing. FIG. 20 shows a wiper set state where the wiping means in an ink jet recording apparatus according to the second embodiment (the modified example) of the invention is advanced to the movement path (wiping position) of the recording head. FIG. 21 shows a wiper reset state where the wiping means in an ink jet recording apparatus according to the second embodiment (the modified example) of the invention is retreated from the movement path of the recording head. In the same drawings, parts that are identical to those in FIG. 16 through FIG. 19 are given the same reference numbers, and detailed description thereof is omitted.

In FIGS. 20 and 21, a spring engaging piece 46*c* that protrudes in a direction parallel to the axial direction of the drive shaft 43 and a spring attaching piece 46*d* are provided on the fixing base 46.

A columnar spring receiving portion 76*b* that projects in a direction parallel to the axial direction of the through hole 46*a* is integrally provided at the base side (non-printing area side) end face of the extending portion 76 at the cleaner drive lever 73. The cleaner drive lever 73 receives a repulsion force (a positioning force) of the spring 301 from engaging positions differing from each other by disengagement of the planet gear 78 from the inner teeth 77, and is positioned at the wiper set (cleaner set) position and the wiper reset (cleaner reset) position.

The spring 301 is formed of a torsion spring having spring end portions 301*a* and 301*b* extending on the rotating surface of the cleaner drive lever 73, and having a spring winding portion 301*c* that is located between both of these spring end portions 301*a* and 301*b*. A repulsion force is applied to the cleaner drive lever 73 so that the same lever 73 is positioned at the cleaner set position and the cleaner reset position.

The spring end portion 301 is engaged at the spring engaging piece 46*c* while the above spring end portion 301*b* is engaged at the spring receiving portion 76*a*. The first positioning portion 302 that applies a positioning force to the cleaner drive lever 73 at the cleaner set position, and the second positioning portion 303 that applies a positioning force thereto at the cleaner reset position are formed so as to be folded at the spring end portion 301*b* thereof. The spring winding portion 301*c* has an axial line parallel to the axial line of the drive shaft 43, is disposed between the fixing base 46 and the cleaner drive lever 73, and is attached to the spring attaching piece 46*d*.

In addition, the repulsion force of the spring 301 is set to such a level that smooth rotations of the cleaner drive lever 73 are not hindered when the cleaner 20 advances and retreats.

In the above-described construction, the cleaner set operation and the cleaner reset operation are carried out as described below;

Cleaner Set Operation

If the sun gear 72 (the drive shaft 43) starts rotation in a normal direction (counterclockwise) from the wiper reset state shown in FIG. 21, the rotation force is transmitted to the gear holding lever 74 via the planet gear 78, wherein the gear holding lever 74 rotates counterclockwise (in the direction shown by the arrow "e").

In this case, as the gear holding lever 74 rotates in the direction shown by the arrow "e", the stopper engaging portion 74D is separated from the stopper 53*d*.

In addition, since the planet gear 78 is disengaged from the inner teeth 77 in the rotation start state of the sun gear 72, the cleaner drive lever 73 does not receive any driving force from the sun gear 72, but receives a positioning force (a repulsion force), which is brought about by the spring 302, counterclockwise (in the direction shown by the arrow "e") from the second positioning portion 303, wherein the cleaner drive lever 73 remains it is stopped at the rotation start position.

The drive pin 75 and slide pin 22*b* are, respectively, positioned at the starting point (the upper end portion) of the recessed groove 22*d* and at the starting point (the left end portion) of the recessed groove 53*a*, and at the same time, the fixing pin 53*b* is positioned at the starting point (the right end portion) of the recessed groove 22*c*.

As the sun gear 72 further rotates counterclockwise, the gear holding lever 74 further rotates in the direction shown by the arrow "e", wherein the stopper engaging portion 74C is caused to engage with the stopper 53*c*, and the stopper engaging portion 74C of the gear holding lever 74 is locked at the rotation stop position at one side.

In this case, as the gear holding lever 74 rotates in the direction shown by the arrow "e", the planet gear 78 rolls on the inner teeth 77 while being mated with the inner teeth 77 and rotating clockwise. For this reason, the cleaner drive lever 73 does not rotate in the direction shown by the arrow "f" (in the direction of causing the cleaner 20 to advance) until the stopper engaging portion 74C is engaged with the stopper 53*c*.

Figure 22:
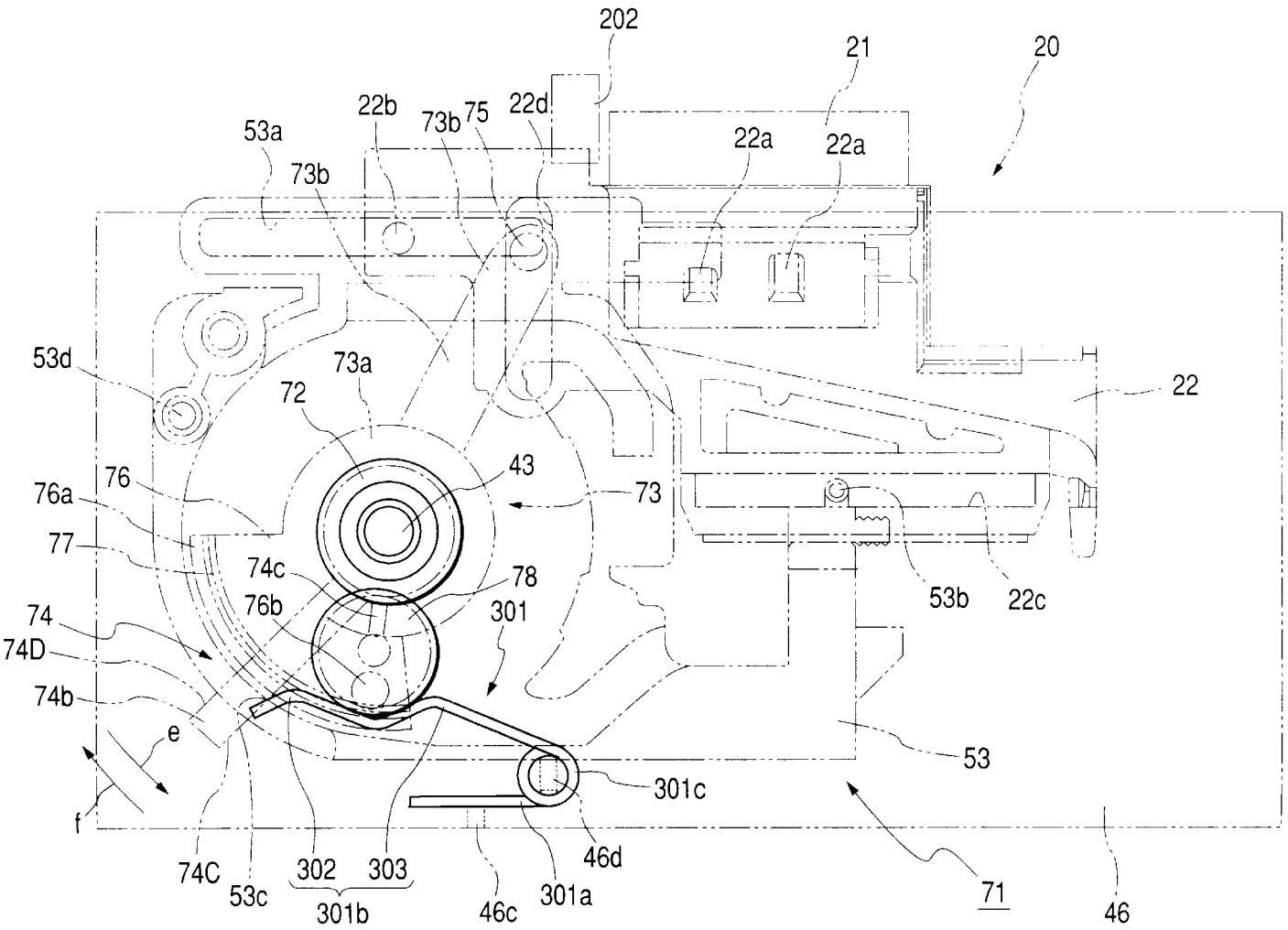
FIG. 22 is a perspective view describing a wiper set starting state.

If the sun gear 72 further rotates counterclockwise in this state, that is, in a state where the stopper engaging portion 74C is engaged with the stopper 53*c*, the planet gear 78 rotates clockwise as shown in FIG. 22, and the cleaner drive lever 73 starts rotation clockwise (in the direction shown by the arrow "f") against the repulsion force of the spring 301.

In this case, the rotation force from the sun gear 72 is transmitted to the gear holding lever 74 via the planet gear 78. However, since the stopper engaging portion 74C of the lever portion 74*b* is engaged with the stopper 53*c*, the gear holding lever 74 does not rotate counterclockwise (that is, in the direction shown by the arrow "e").

Therefore, if the rotation force from the sun gear 72 is transmitted to the gear holding lever 74 via the planet gear 78, the lever portion 74*c* bends in the direction approaching the lever portion 74*b*.

Further, if the sun gear 72 further rotates counterclockwise, the planet gear 78 further rotates clockwise as shown in FIG. 20, wherein the cleaner drive lever 73 rotates in the direction shown by the arrow "f".

In this case, the cleaner 20 moves in the direction shown by the arrow "g" as shown in FIG. 20 and advances from the outside of the movement path of the recording head 5 to the inside (the cleaning position) thereof, wherein the nozzle forming surface of the recording head 5 is wiped off in line with movement of the recording head 5.

The wiper cleaner 202 is resiliently deformed by a sliding contact with the cleaning member 21 halfway through advancement of the cleaner 20 (that is, before reaching the wiper set position), and the ink wiping-off portion of the cleaning member 21 can be cleaned up.

In addition, as the cleaner 20 advances in the movement path of the recording head 5 (that is, the cleaner drive lever 73 rotates by 66° clockwise from the rotation start position), the lever portion 74*c* of the gear holding lever 74 is resiliently reset, and the planet gear 78 is disengaged from the inner teeth 77. For this reason, the cleaner drive lever 73 does not receive any driving force from the sun gear 72, but receives a positioning force (a repulsion force), which is brought about by the spring 301, from the first positioning portion 302, and the cleaner drive lever 73 is disposed at the rotation end position.

The drive pin 75 moves from the starting point (the upper end portion) of the recessed groove 22*d* and is positioned at the terminating point (the lower end portion), and at the same time, the slide pin 22*b* moves from the starting point (the left end portion) of the recessed groove 53*a*, and is positioned at the terminating point (the right end portion). Further, the fixing pin 53*b* is positioned at the terminating point (the left end portion) of the recessed groove 22*c*.

Cleaner Reset Operation

If the sun gear 72 (the drive shaft 43) starts reversing (clockwise) from the wiper set state shown in FIG. 20, the rotation force is transmitted to the gear holding lever 74 via the planet gear 78, wherein the gear holding lever 74 rotates clockwise (in the direction shown by the arrow "f").

In this case, if the gear holding lever 74 rotates in the direction shown by the arrow "f", the stopper engaging portion 74C is separated from the stopper 53*c*.

Since the planet gear 78 is disengaged from the inner teeth 77 in the rotation start state of the sun gear 72, the cleaner drive lever 73 does not receive any driving force from the sun gear 72, but receives a positioning force (a repulsion force), which is brought about by the spring 301, clockwise (in the direction shown by the arrow "f") from the first positioning portion 302, and the cleaner drive lever 73 remains as it is stopped at the rotation end position.

The drive pin 75 and the slide pin 22*b* are, respectively, positioned at the terminating point (the lower end portion) of the recessed groove 22*d* and at the terminating point (the right end portion) of the recessed groove 53*a*, and at the same time, the fixing pin 53*b* is positioned at the terminating point (the left end portion) of the recessed groove 22*c*.

If the sun gear 72 further rotates clockwise, the gear holding lever 74 further rotates in the direction shown in the arrow "f", wherein the stopper engaging portion 74D is caused to engage with the stopper 53*d*, and the gear holding lever 74 is locked at the rotation stop position at the other side.

In this case, if the gear holding lever 74 rotates in the direction shown by the arrow "f", the planet gear 78 rolls on the inner teeth 77 while being mated with the inner teeth 77 and rotating counterclockwise. For this reason, the cleaner drive lever 73 does not rotate in the direction shown by the arrow "e" (that is, in the direction of causing the cleaner 20 to retreat) until the stopper engaging portion 74D is engaged with the stopper 53*d*.

Figure 23:
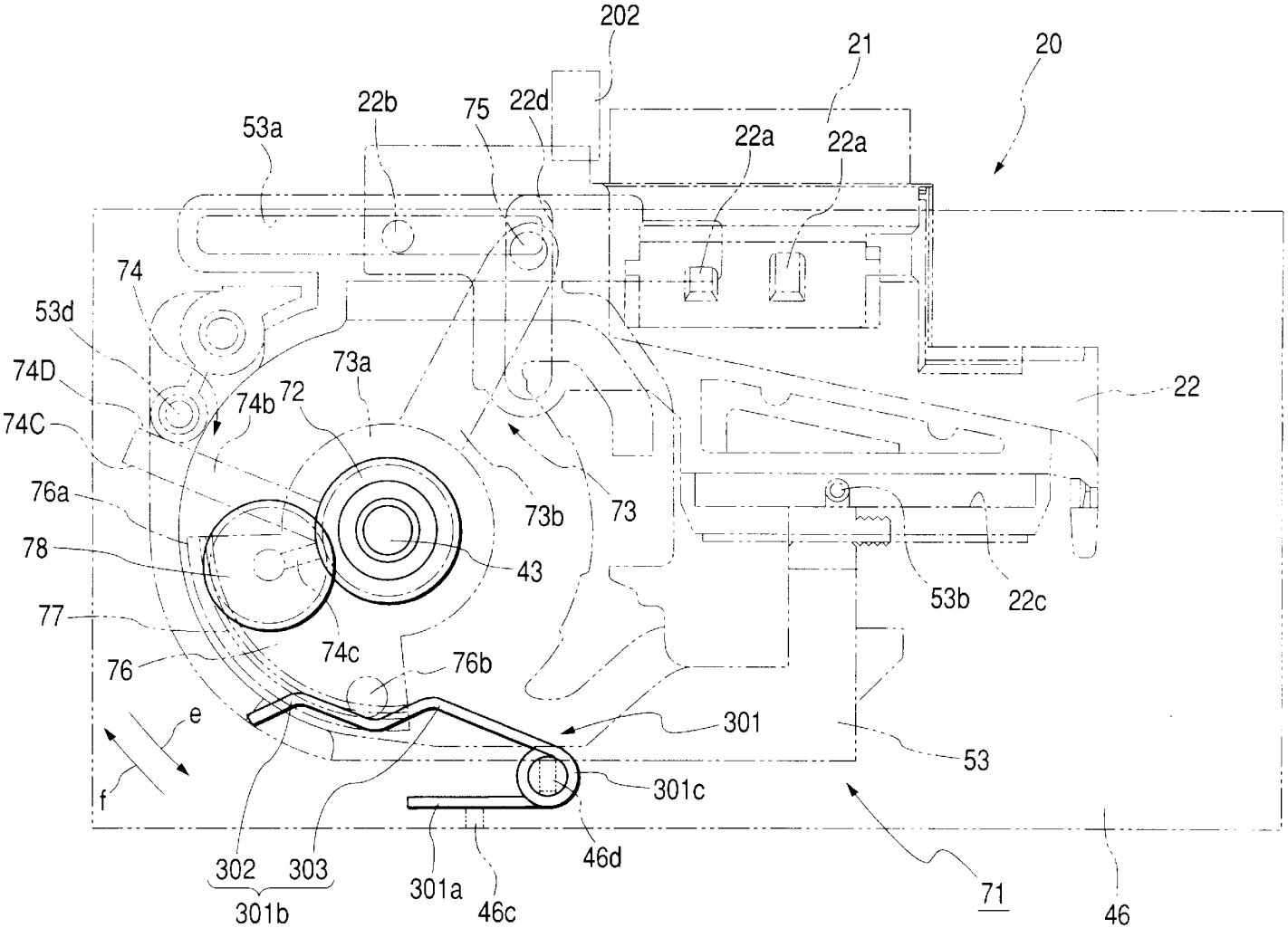
FIG. 23 is a perspective view describing a wiper reset starting state.
Figure 24:
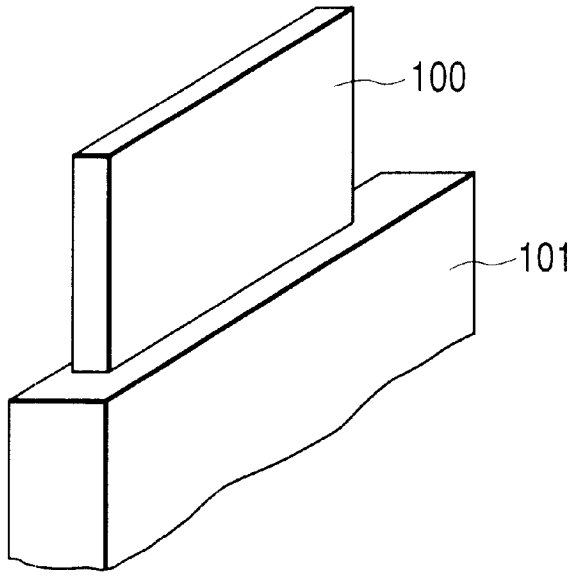
FIG. 24 is a perspective view showing a cleaning member.
Figure 25:
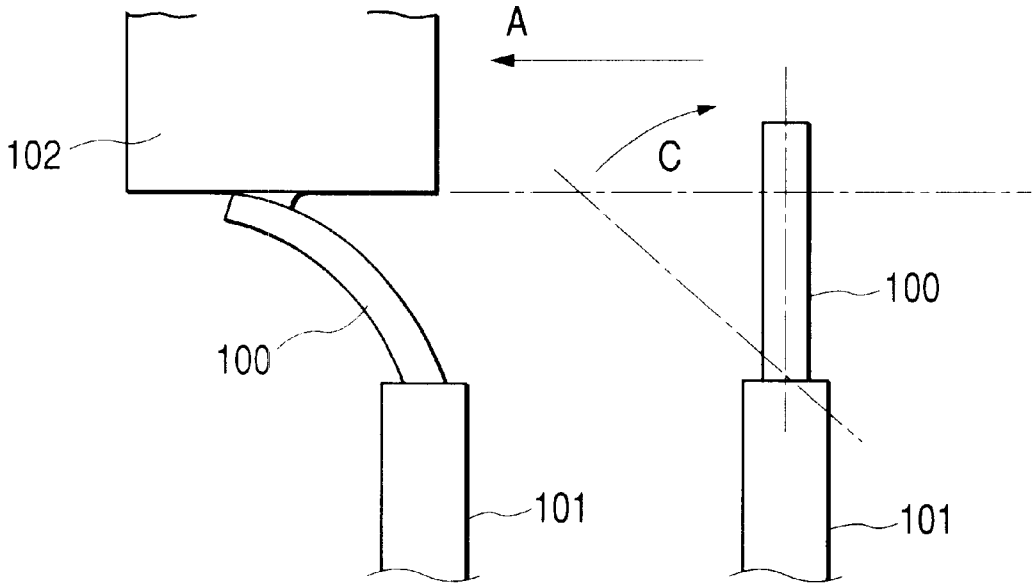
FIG. 25 is a side view describing a wiping operation using the cleaning member shown in FIG. 24.

If the sun gear 72 further rotates clockwise in this state, that is, in a state where the stopper engaging portion 74D is engaged with the stopper 53*d*, the planet gear 78 rotates counterclockwise as shown in FIG. 23, and the cleaner drive lever 73 starts rotation counterclockwise (in the direction shown by the arrow "e") against the repulsion force of the spring 300.

In this case, the rotation force from the sun gear 72 is transmitted to the gear holding lever 74 via the planet gear 78. However, since the stopper engaging portion 74D of the lever portion 74*b* is engaged with the stopper 53*d*, the gear holding lever 74 does not rotate in the direction shown by the arrow "f".

Therefore, if the rotation force from the sun gear 72 is transmitted to the gear holding lever 74 via the planet gear 78, the lever portion 74*c* bends in the direction of separating from the lever portion 74*b*.

As the sun gear 72 further rotates clockwise, the planet gear 78 rotates counterclockwise as shown in FIG. 21, and the cleaner drive lever 73 rotates in the direction shown by the arrow "e".

In this case, the cleaner 20 moves in the direction shown by the arrow "h", and retreats from the inside of the movement path of the recording head 5 to the outside thereof.

The wiper cleaner 202 is resiliently deformed by a sliding contact with the cleaning member 21 halfway through advancement of the cleaner 20 (that is, before reaching the wiper reset position), and the ink wiping-off portion of the cleaner member 21 is cleaned up.

In addition, if the cleaner 20 retreats to the outside of the movement path of the recording head 5 (the cleaner drive lever 73 rotates by 66° counterclockwise from the rotation end position), the lever portion 74*c* of the gear holding lever 74 is resiliently reset, and the planet gear 78 is disengaged from the inner teeth 77. Therefore, the cleaner drive lever 73 does not receive any driving force from the sun gear 72, but receives a repulsion force, which is brought about by the spring 301, counterclockwise (in the direction shown by the arrow "e") from the second positioning portion 303, and the cleaner drive lever 73 is disposed at the rotation start position.

Herein, as the cleaner 20 is separated from the recording head 5 by a retreating action, the recording head 5 moves from the cleaner position to the printing area side. That is, the planet gear 78 is disengaged from the inner teeth 77 immediately before the recording head 5 passes through the cleaning position in the movement path, wherein the cleaning operation is terminated.

Further, the drive pin 75 moves from the terminating point (the lower end portion) of the recessed groove 22*d* and is positioned at the starting point (the upper end portion), and at the same time, the slide pin 22*b* moves from the terminating point (the right end portion) of the recessed groove 53*a* and is positioned at the starting point (the left end portion). The fixing pin 53*b* is positioned at the starting point (the right end portion) of the recessed groove 22*c*.

Therefore, in the present embodiment (the modified example), since the cleaner drive lever 73 is positioned at the cleaner set and reset positions by a repulsion force of the spring 301, a stabilized cleaning operation can be obtained as in the case of positioning by the spring 201, and it is possible to increase the durability of the components, etc., and to prevent abnormal noise from occurring.

As has been made clear in the above description, with the ink jet recording apparatus according to the invention, it is possible to increase reliability with respect to the operations of the capping means and cleaner.

The durability of the pump can be increased in the case where the drive shaft of the cleaner is a pump shaft of the ink suction pump, and simultaneously, where the drive source of the cleaner is a paper feeding motor, it is possible to prevent printing from being disordered.

What is claimed is:

1. An ink jet recording apparatus including:

a carriage reciprocating in the apparatus;

a recording head mounted on the carriage and discharging ink from a nozzle forming surface;

a cleaner disposed in a vicinity of a movement path of the recording head so as to advance and retreat, and having a cleaning member to wipe off the nozzle forming surface; and a driving mechanism for the cleaner including a drive shaft provided with a sun gear rotatably disposed on a fixing base, a gear holding lever pivotally and rotatably supported on the drive shaft between two rotation stop positions and rotatably holding a planet gear engaging with the sun gear, and a cleaner drive lever juxtaposed to the gear holding lever, rotatably and pivotally supported at the drive shaft, and having inner teeth engageable with the planet gear;

wherein the cleaner drive lever is rotated by a rotation of the sun gear through engagement of the inner teeth with the planet gear in a rotation stop state of the gear holding lever, so that a driving force is applied to the cleaner.

2. An ink jet recording apparatus according to claim 1, wherein stoppers corresponding to the two rotation stop positions are provided on the fixing base, and stopper engageable portions are provided on the gear holding lever.

3. An ink jet recording apparatus according to claim 1, wherein the fixing base is constituted by a frame of an ink suction pump and an attaching base of the frame.

4. An ink jet recording apparatus according to claims 3, wherein the drive shaft is a pump drive shaft of the ink suction pump.

5. An ink jet recording apparatus according to claim 4, wherein the driving mechanism applies a driving force to the cleaner so that the cleaner is caused to advance to the movement path by rotations of the pump drive shaft in a suction direction and is caused to retreat from the movement path by rotations in a direction opposed to the suction direction.

6. An ink jet recording apparatus according to claim 5, wherein the driving force is an advancing and retreating force in the direction perpendicular to the reciprocation direction of the carriage.

7. An ink jet recording apparatus according to claim 1, wherein the gear holding lever is provided with a lever resiliently deformable by rotation of the cleaner drive lever in a state where the gear holding lever is locked at the rotation stop position.

8. An ink jet recording apparatus according to claim 1, wherein the driving mechanism includes further a spring, by which the cleaner drive lever is positioned so as to be urged to a cleaner set position or a cleaner reset position, in accordance with release of an engagement between the planet gear and the inner teeth.

9. An ink jet recording apparatus according to claim 8, wherein the spring is constituted by a torsion spring, and one end of the torsion spring is fixed at the fixing base, and another end of the torsion spring is fixed at the cleaner drive lever.

10. An ink jet recording apparatus according to claim 9, fixing position of the spring with respect to the cleaner drive lever are the same positions respectively between the cleaner set position and the cleaner reset position.

11. An ink jet recording apparatus according to claim 9, wherein the fixing positions of the spring with respect to the cleaner drive lever between the cleaner set position and the cleaner reset position differs from each other respectively.

* * * * *